US009689341B2

(12) United States Patent
Pursifull et al.

(10) Patent No.: US 9,689,341 B2
(45) Date of Patent: Jun. 27, 2017

(54) METHOD AND SYSTEM FOR FUEL SYSTEM CONTROL

(71) Applicant: Ford Global Technologies, LLC, Dearborn, MI (US)

(72) Inventors: Ross Dykstra Pursifull, Dearborn, MI (US); Christopher Arnold Woodring, Canton, MI (US); Joseph Norman Ulrey, Dearborn, MI (US); David Ord, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 228 days.

(21) Appl. No.: 14/733,794

(22) Filed: Jun. 8, 2015

(65) Prior Publication Data

US 2016/0356237 A1 Dec. 8, 2016

(51) Int. Cl.

| | |
|---|---|
| ***F02D 41/38*** | (2006.01) |
| ***F02D 41/30*** | (2006.01) |
| *F02D 41/20* | (2006.01) |

(52) U.S. Cl.

CPC ..... *F02D 41/3854* (2013.01); *F02D 41/3082* (2013.01); *F02D 2041/2051* (2013.01); *F02D 2250/02* (2013.01)

(58) Field of Classification Search

CPC ... F02D 41/3082; F02D 41/3854; F02D 41/38
USPC ..... 123/497
See application file for complete search history.

(56) References Cited

U.S. PATENT DOCUMENTS

| | | | |
|---|---|---|---|
| 3,868,939 | A | 3/1975 | Friese et al. |
| 4,083,340 | A | 4/1978 | Furr et al. |
| 4,393,848 | A | 7/1983 | Poehlman |
| 4,665,881 | A | 5/1987 | Wade |
| 5,159,915 | A | 11/1992 | Saito et al. |
| 5,182,942 | A | 2/1993 | Hartel et al. |
| 5,460,330 | A | 10/1995 | Steeb et al. |
| 5,687,696 | A | 11/1997 | Takagi et al. |
| 5,842,454 | A | 12/1998 | Miwa et al. |

(Continued)

FOREIGN PATENT DOCUMENTS

| | | | |
|---|---|---|---|
| GB | 2310458 | A | 8/1997 |
| JP | 361175251 | A1 | 8/1986 |

(Continued)

OTHER PUBLICATIONS

Woodring, C. et al. "Fuel Delivery System with a Parallel Port Pressure Relief Valve," U.S. Appl. No. 12/119,650, filed May 13, 2008, 28 pages.

(Continued)

*Primary Examiner* — Erick Solis
(74) *Attorney, Agent, or Firm* — Julia Voutyra; McCoy Russell LLP

(57) ABSTRACT

Methods and systems are provided for increasing a lift pump voltage to a high threshold voltage responsive to a DI pump efficiency being below a threshold efficiency, and increasing a lift pump voltage to a first threshold voltage less than the high threshold voltage responsive to a main jet pump fuel reservoir level being less than a first threshold reservoir level. The approach increases fuel jet pump performance and thereby reducing engine stalls induced by fuel vaporization, while maintaining DI pump efficiency and fuel economy.

20 Claims, 10 Drawing Sheets

(56) References Cited

U.S. PATENT DOCUMENTS

| | | | |
|---|---|---|---|
| 5,878,718 | A | 3/1999 | Rembold et al. |
| 6,053,036 | A | 4/2000 | Uto et al. |
| 6,070,529 | A | 6/2000 | Miller |
| 6,192,864 | B1 | 2/2001 | Nishimura |
| 6,227,151 | B1 | 5/2001 | Ma |
| 6,325,051 | B1 | 12/2001 | Oomori et al. |
| 6,339,921 | B1 | 1/2002 | Lassmann et al. |
| 6,371,094 | B1 | 4/2002 | Wagner |
| 6,373,932 | B2 | 4/2002 | Bakshi et al. |
| 6,374,807 | B1 | 4/2002 | Atanasyan et al. |
| 6,481,641 | B1 | 11/2002 | Mieney |
| 6,539,921 | B1 | 4/2003 | Matsumura |
| 6,708,671 | B1 | 3/2004 | Joos et al. |
| 6,755,183 | B2 | 6/2004 | Frech et al. |
| 6,802,209 | B2 | 10/2004 | Joos et al. |
| 6,814,058 | B2 | 11/2004 | Oono |
| 7,013,720 | B2 | 3/2006 | Date |
| 7,093,426 | B2 | 8/2006 | Ichihara et al. |
| 7,272,485 | B2 | 9/2007 | Amano et al. |
| 7,426,919 | B2 | 9/2008 | Kano et al. |
| 7,448,367 | B1 | 11/2008 | Reddy et al. |
| 7,640,916 | B2 | 1/2010 | Ulrey et al. |
| 7,681,558 | B2 | 3/2010 | Gale et al. |
| 7,703,435 | B2 | 4/2010 | Surnilla et al. |
| 8,151,771 | B2 | 4/2012 | Pursifull et al. |
| 2002/0061297 | A1 | 5/2002 | Gunzburg et al. |
| 2007/0137601 | A1 | 6/2007 | Stanglmaier |
| 2009/0090331 | A1 | 4/2009 | Pursifull |
| 2015/0219037 | A1* | 8/2015 | Ramamurthy ..... F02D 41/3082 137/565.11 |
| 2016/0153385 | A1* | 6/2016 | Pursifull ..... F02D 41/3845 123/299 |
| 2016/0153388 | A1* | 6/2016 | Sanborn ..... F02M 39/00 123/458 |

FOREIGN PATENT DOCUMENTS

| | | | |
|---|---|---|---|
| JP | H109073 | A | 1/1998 |
| WO | 2007116303 | A1 | 10/2007 |

OTHER PUBLICATIONS

Ulrey, J. et al. "Current Pulsing Control Methods for Lift Fuel Pumps," U.S. Appl. No. 14/444,739, filed Jul. 28, 2014, 48 pages.
Pursifull, R. "Fuel Rail Pressure Relief," SAE Technical Paper Series No. 2006-01-0626, Visteon Corporation, SAE International 2006, 11 pages.

* cited by examiner

FIG. 12

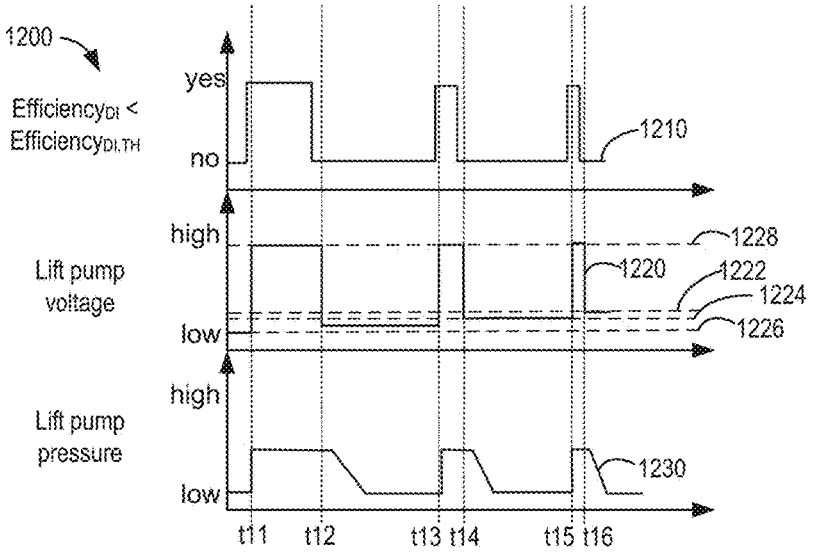

FIG. 13

1300

| Control mode | Control mode description | Condition | Control action |
|---|---|---|---|
| 1 | 2nd level fuel condition | $Level_{MainSump} < Level_{Reservoir,TH1}$ OR $Level_{Reservoir} < Level_{Reservoir,TH1}$ | Enforce $V_{LiftPump} \geq V_{LiftPump,TH1}$ |
| 2 | 1st level fuel condition | $Level_{FuelTank} < Level_{Sump,TH}$ OR $Level_{Reservoir} < Level_{Reservoir,TH2}$ | Enforce $V_{LiftPump} \geq V_{LiftPump,TH2}$ |
| 3 | FRP detection time condition | $t_{FRP} < t_{FRP,TH}$ OR $DC_{DI} > DC_{DI,TH}$ OR Engine Speed > Engine Speed$_{TH}$ OR $Q_{inj,fuel} > Q_{inj,fuel,TH}$ | Set $V_{LiftPump} = V_{LiftPump,TH3}$ |
| 4 | DI pump efficiency condition | Efficiency$_{DI}$ < Efficiency$_{DI,TH}$ | Pulse $V_{LiftPump}$ to $V_{High,TH}$ Increment $V_{LiftPump}$ by $\Delta V_{INC,TH}$ |
| Base | Fuel vaporization condition | $V_{LiftPump} < V_{fuel,novap}$ | Set $V_{LiftPump} = V_{fuel,novap}$ |

METHOD AND SYSTEM FOR FUEL SYSTEM CONTROL

FIELD

The field of the disclosure generally relates to fuel systems in internal combustion engines.

BACKGROUND AND SUMMARY

Lift pump control systems may be used for a variety of fuel system control purposes. These may include, for example, fuel injection vapor management, injection pressure control, temperature control, and lubrication. In one example, a lift pump supplies fuel to a higher pressure fuel pump (DI pump) that provides a high injection pressure for direct injectors in an internal combustion engine. The DI pump may provide the high injection pressure by supplying high pressure fuel to a fuel rail to which the direct injectors are coupled. A fuel pressure sensor may be disposed in the fuel rail to enable measurement of the fuel rail pressure, on which various aspects of engine operation may be based, such as fuel injection. Furthermore, a lift pump may be operated to apply just enough fuel pressure to the DI pump in order to maintain volumetric efficiency of the DI pump while preserving fuel economy.

However, the inventors herein have identified potential issues with such systems. The lift pump pressures applied to maintain DI pump efficiency may be low, especially during cold fuel conditions, thereby reducing performance of jet pumps inside the fuel tank, which can cause low fuel tank and jet pump fuel reservoir levels. Low fuel tank and low jet pump fuel reservoir levels can lead to low fuel line pressures, fuel vaporization within the fuel system, and a precipitous drop in DI fuel rail pressure, causing the engine to stall.

In one example, the above issues may be addressed by a method comprising: increasing a lift pump voltage to a high threshold voltage responsive to a DI pump volumetric efficiency being below a threshold volumetric efficiency, and increasing a lift pump voltage to a first threshold voltage less than the high threshold voltage responsive to a main jet pump fuel reservoir level being less than a first threshold reservoir level. In this way, the technical result of maintaining jet pump fuel flow and performance while preserving DI pump efficiency may be achieved. Accordingly, a risk of fuel vaporization within the liquid fuel delivery system and large DI fuel rail pressure drops can be reduced, and engine operation robustness may be increased while maintaining fuel economy.

In one example, if the DI pump volumetric efficiency decreases below a threshold volumetric efficiency, the lift pump voltage will be increased to a high threshold voltage in order to mitigate the DI pump volumetric efficiency drop and to restore the DI pump volumetric efficiency to the threshold volumetric efficiency. Furthermore, in response to a fuel reservoir fuel level decreasing below a first threshold reservoir fuel level, the lift pump voltage may be increased to a second threshold voltage less than the high threshold voltage. In this manner, both engine operation with low DI fuel pump efficiency, and fuel vaporization arising from low fuel reservoir levels and low jet pump flow can be mitigated while preserving fuel economy.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 12 shows an example timeline for operating a lift pump in a pulse and increment mode.

FIG. 13 shows a table of example control modes for a operating a lift pump in a fuel system.

DETAILED DESCRIPTION

Figure 1:
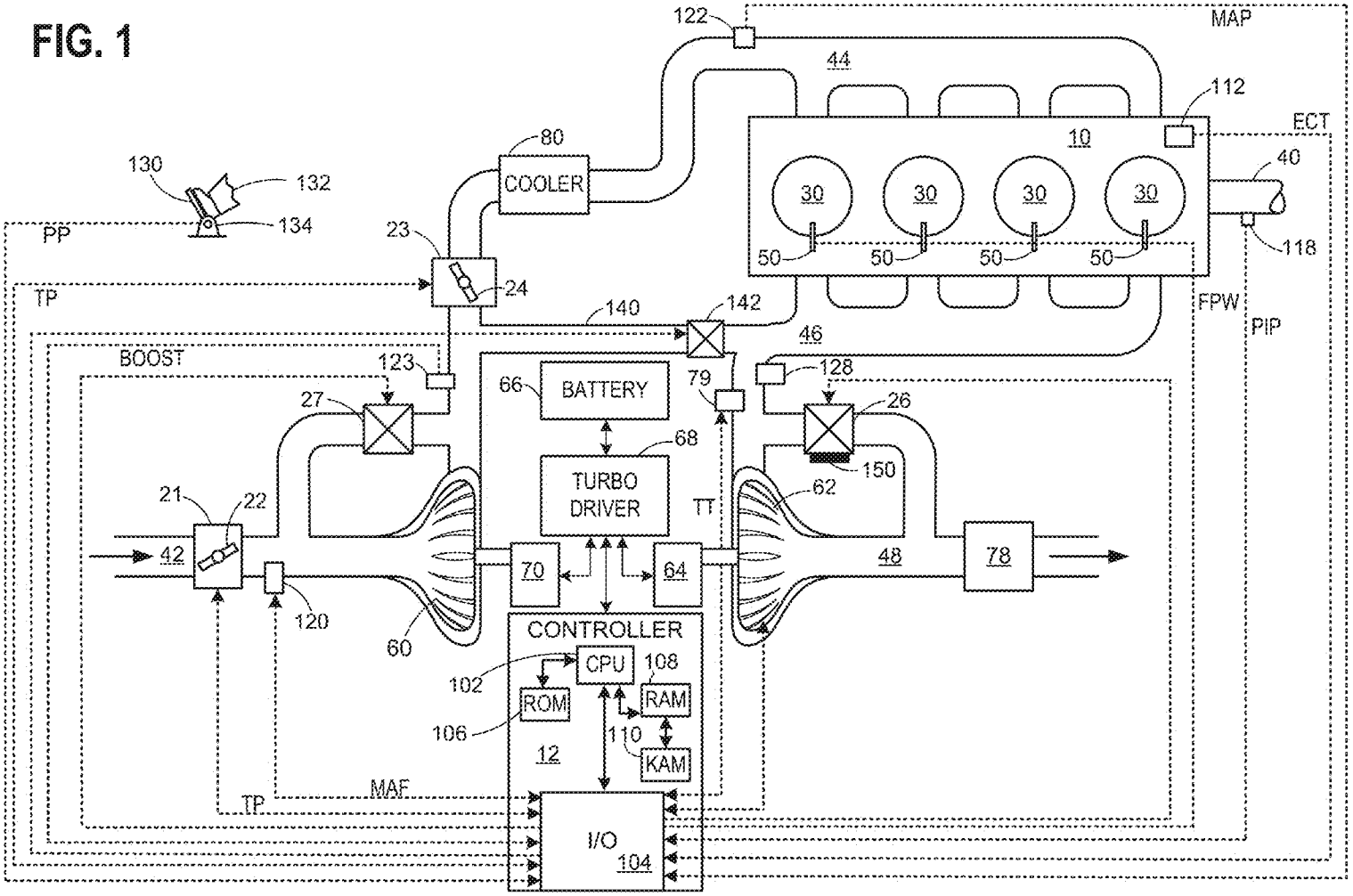
FIG. 1 is a schematic diagram showing an example engine.
Figure 2:
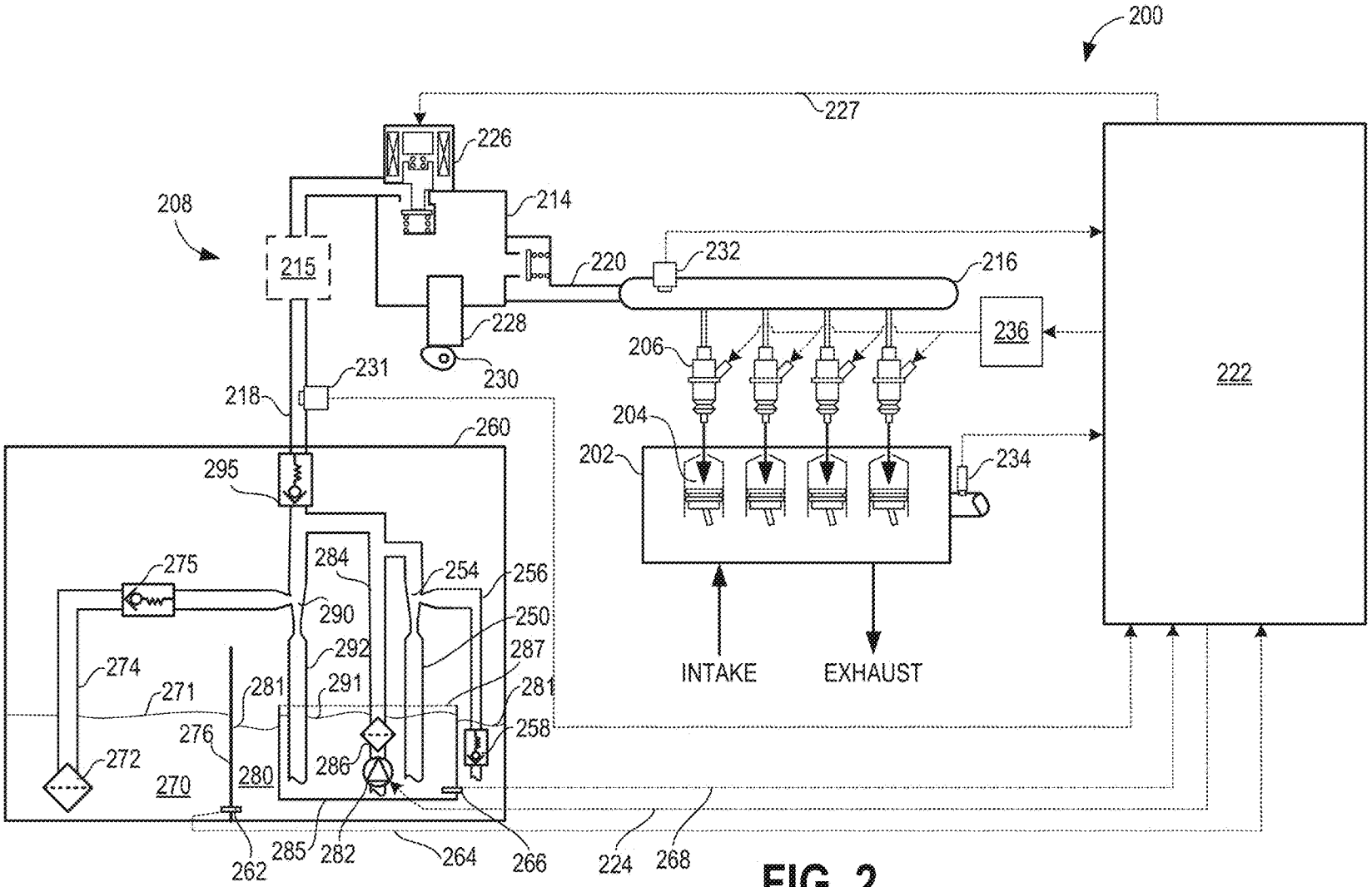
FIG. 2 shows an example of a direct injection engine system, including a fuel tank system.
Figure 6:
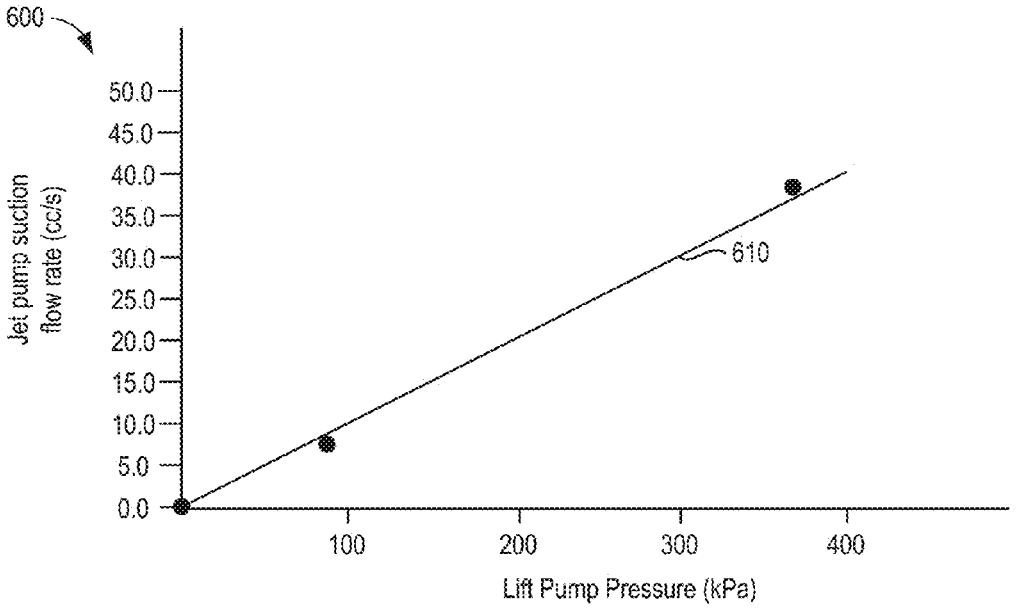
FIG. 6 shows a graph illustrating jet pump flow as a function of lift pump pressure.
Figure 7:
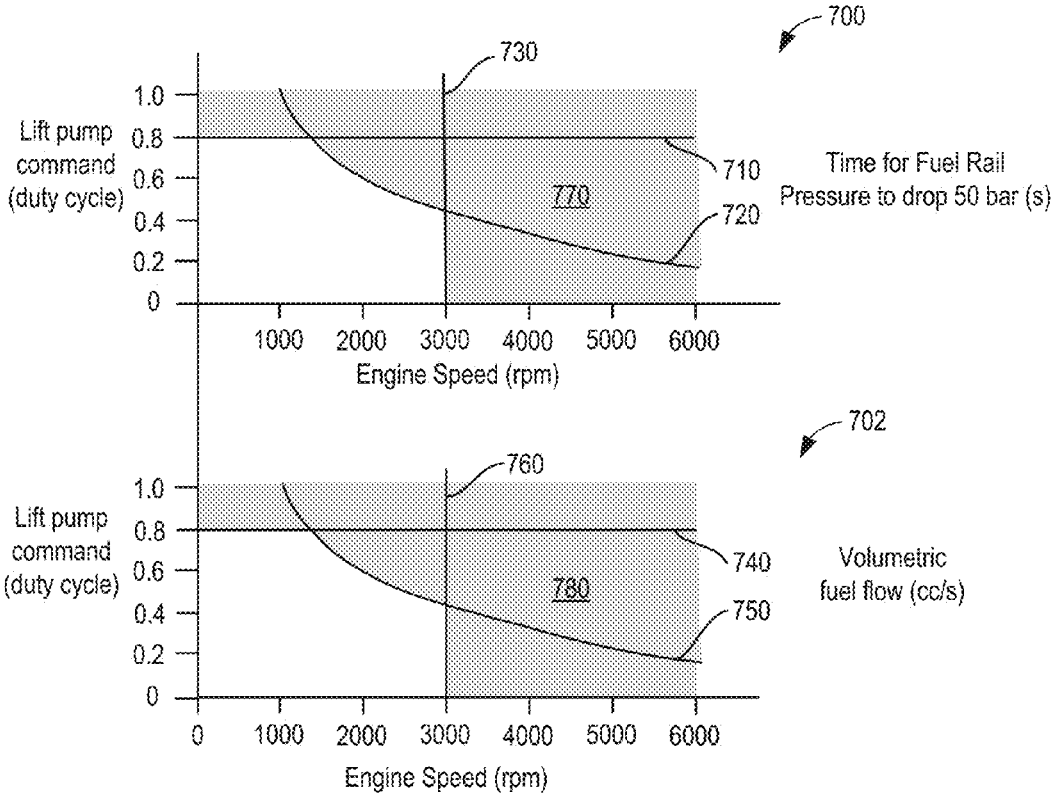
FIG. 7 shows plot of time for fuel rail pressure to drop 50 bar as a function of DI pump command (duty cycle) and engine speed.
Figure 8:
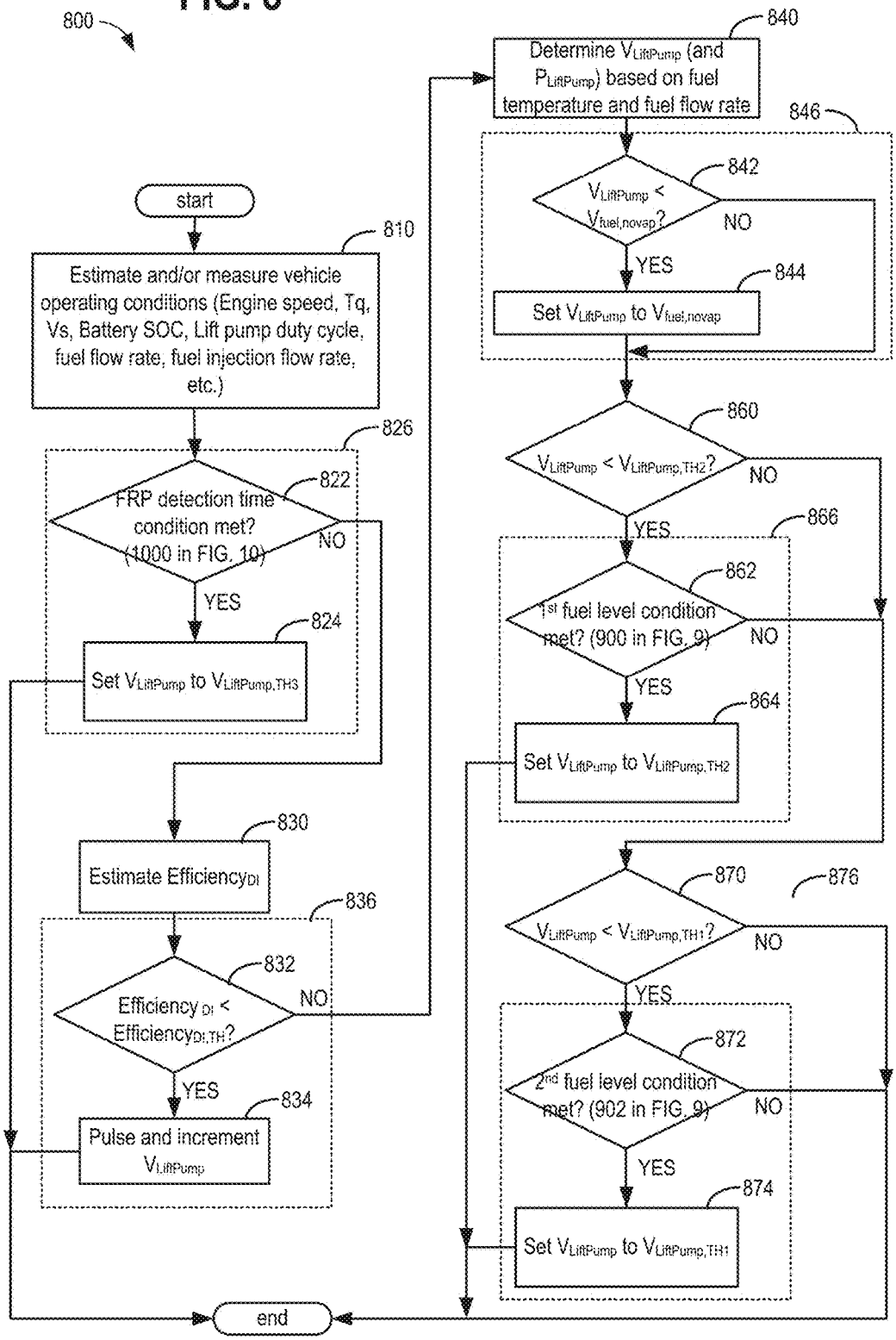
FIGS. 8-10 show a flowchart illustrating a method for adjusting pump command in a fuel system lift pump to maintain DI pump efficiency and fuel system jet pump flow.
Figure 9:
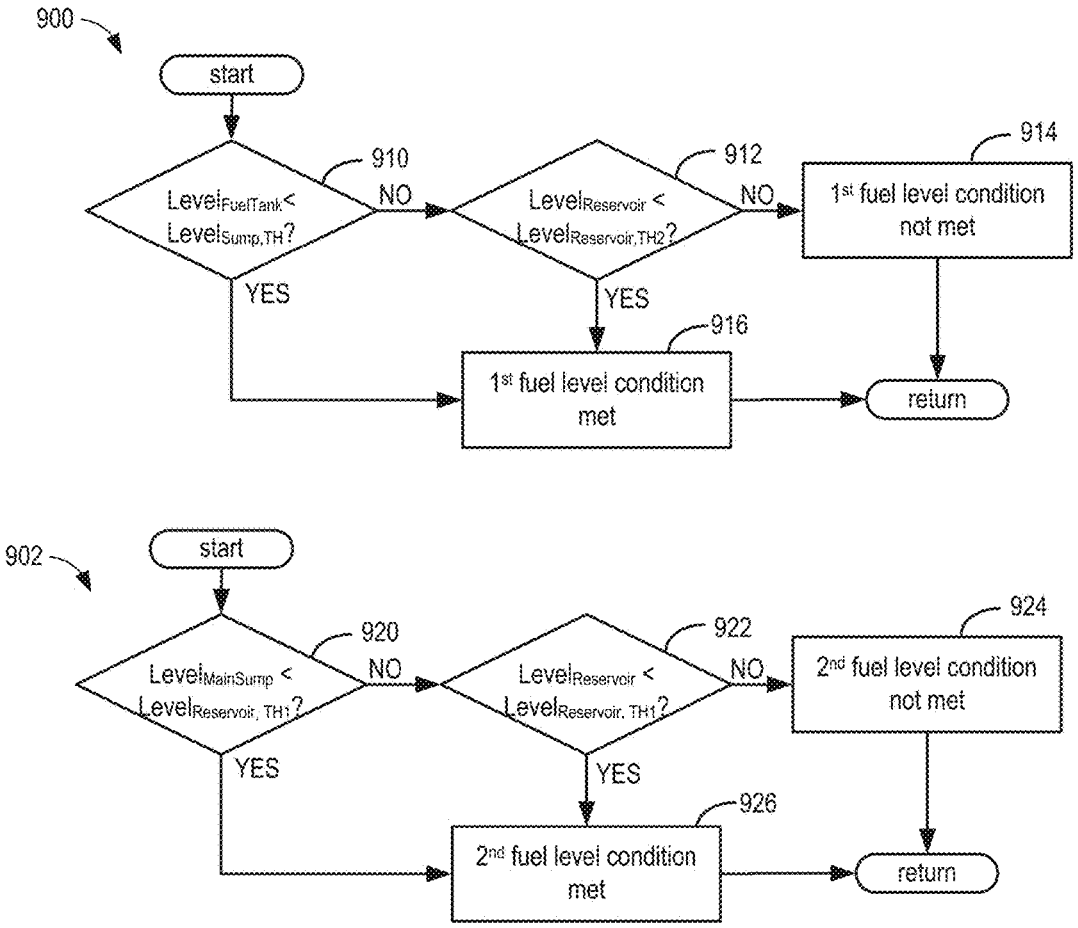
Figure 10:
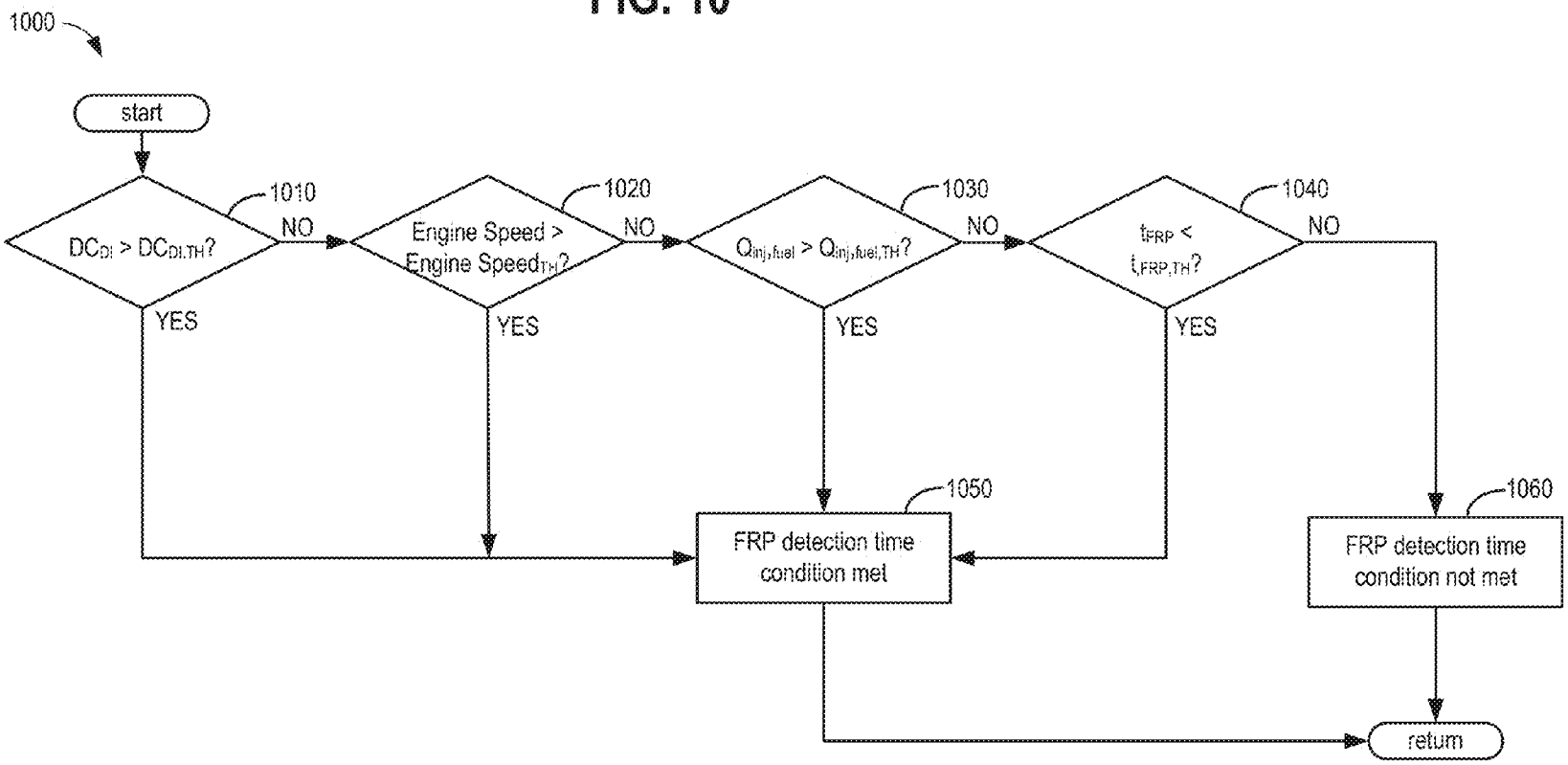
Figure 11:
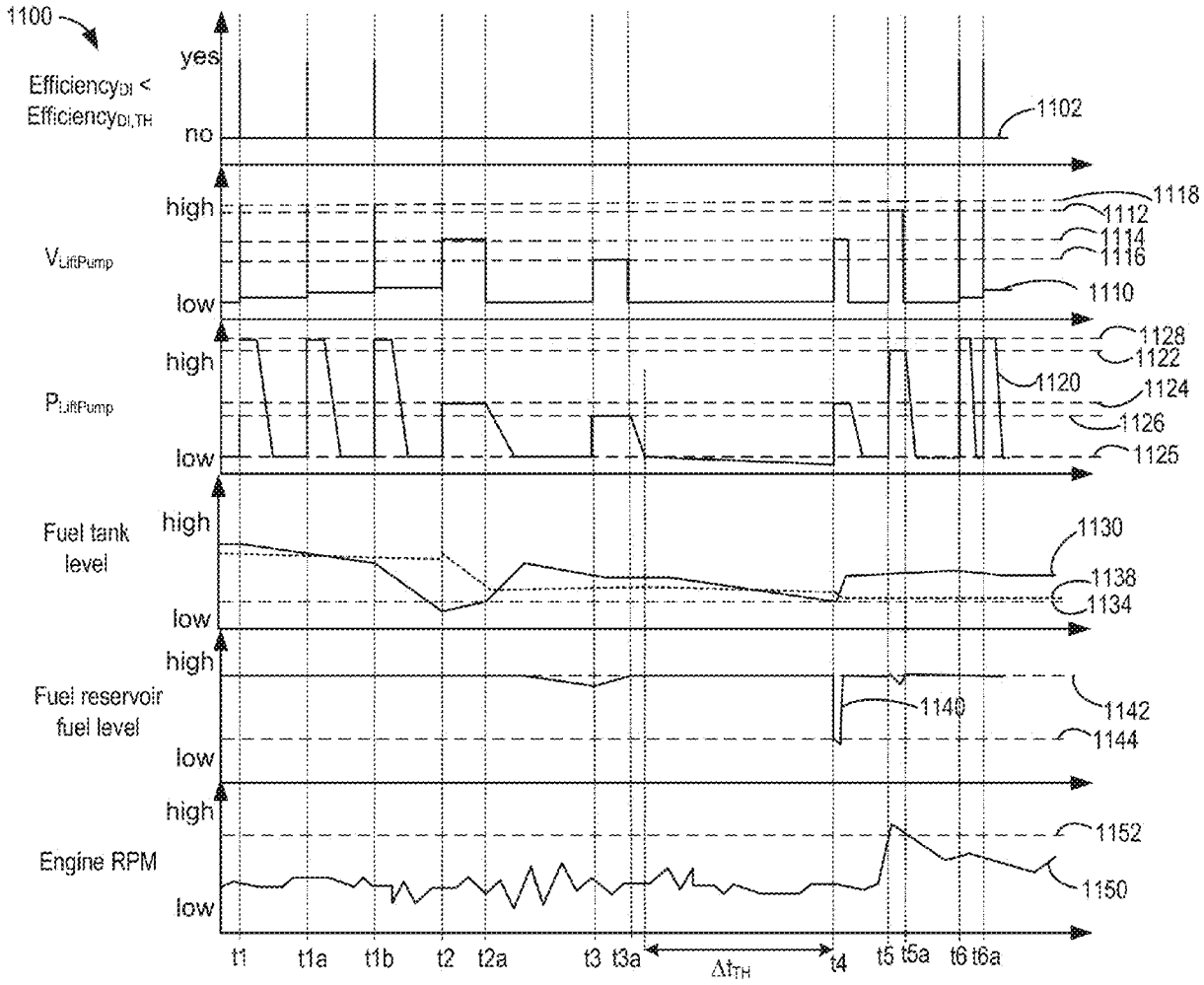
FIG. 11 shows an example timeline for operating a lift pump in a fuel system.

Methods and systems are provided for increasing robustness of engine operation while maintaining fuel economy by adjusting lift pump pressure operation to maintain jet pump fuel flow and performance in fuel systems shown in FIGS. 1-2. One or more jet pumps, such as the example jet pump in FIG. 4, may be operated in conjunction with a lift pump as shown in the example fuel tank system of FIG. 3, and as is depicted by the example main jet pump that transfers fuel to a main jet pump fuel reservoir in FIG. 5. The influence of lift pump pressure (or voltage) and duty cycle on jet pump flow, and fuel rail pressure and volumetric fuel flow as a function of engine speed, are shown in FIGS. 6 and 7, respectively. A lift pump voltage may be commanded to provide a desired lift pump pressure, as shown in the example timelines of FIGS. 11 and 12. For example, a controller may be configured to execute instructions contained therein, such as the method of FIGS. 8-10, to increase the lift pump pressure or voltage in response to a fuel tank level condition or a DI pump efficiency level in order to maintain jet pump fuel flow and performance and mitigate engine shutdown risks, while preserving DI pump efficiency. The controller executable instructions of the method of FIGS. 8-10 are summarized in a table of control modes in FIG. 13. Examples of lift pump adjustments responsive to low fuel tank level conditions and low DI pump efficiencies are shown in FIG. 11 and FIG. 12. In this way, jet pump flow and performance can be maintained, and engine stalls are reduced while maintaining fuel economy.

FIG. 1 is a schematic diagram showing an example engine 10, which may be included in a propulsion system of an automobile. The engine 10 is shown with four cylinders 30.

However, other numbers of cylinders may be used in accordance with the current disclosure. Engine 10 may be controlled at least partially by a control system including controller 12, and by input from a vehicle operator 132 via an input device 130. The controller 12 receives signals from the various sensors of FIG. 1 and employs the various actuators of FIG. 1 to adjust engine operation based on the received signals and instructions stored on a memory of the controller. In this example, input device 130 includes an accelerator pedal and a pedal position sensor 134 for generating a proportional pedal position signal PP. Each combustion chamber (e.g., cylinder) 30 of engine 10 may include combustion chamber walls with a piston (not shown) positioned therein. The pistons may be coupled to a crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel to enable a starting operation of engine 10.

Combustion chambers 30 may receive intake air from intake manifold 44 via intake passage 42 and may exhaust combustion gasses via exhaust passage 48. Intake manifold 44 and exhaust manifold 46 can selectively communicate with combustion chamber 30 via respective intake valves and exhaust valves (not shown). In some embodiments, combustion chamber 30 may include two or more intake valves and/or two or more exhaust valves.

Fuel injectors 50 are shown coupled directly to combustion chamber 30 for injecting fuel directly therein in proportion to the pulse width of signal FPW received from controller 12. In this manner, fuel injector 50 provides what is known as direct injection of fuel into combustion chamber 30. The fuel injector may be mounted in the side of the combustion chamber or in the top of the combustion chamber, for example. Fuel may be delivered to fuel injector 50 by a fuel system (not shown) including a fuel tank, a fuel pump, and a fuel rail. An example fuel system that may be employed in conjunction with engine 10 is described below with reference to FIG. 2. In some embodiments, combustion chambers 30 may alternatively, or additionally, include a fuel injector arranged in intake manifold 44 in a configuration that provides what is known as port injection of fuel into the intake port upstream from each combustion chamber 30.

Intake passage 42 may include throttle 21 and 23 having throttle plates 22 and 24, respectively. In this particular example, the position of throttle plates 22 and 24 may be varied by controller 12 via signals provided to an actuator included with throttles 21 and 23. In one example, the actuators may be electric actuators (e.g., electric motors), a configuration that is commonly referred to as electronic throttle control (ETC). In this manner, throttles 21 and 23 may be operated to vary the intake air provided to combustion chamber 30 among other engine cylinders. The position of throttle plates 22 and 24 may be provided to controller 12 by throttle position signal TP. Intake passage 42 may further include a mass air flow sensor 120, a manifold air pressure sensor 122, and a throttle inlet pressure sensor 123 for providing respective signals MAF (mass airflow) MAP (manifold air pressure) to controller 12.

Exhaust passage 48 may receive exhaust gasses from cylinders 30. Exhaust gas sensor 128 is shown coupled to exhaust passage 48 upstream of turbine 62 and emission control device 78. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO, a NOx, HC, or CO sensor, for example. Emission control device 78 may be a three way catalyst (TWC), NOx trap, various other emission control devices, or combinations thereof.

Exhaust temperature may be measured by one or more temperature sensors (not shown) located in exhaust passage 48. Alternatively, exhaust temperature may be inferred based on engine operating conditions such as speed, load, AFR, spark retard, etc.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112, shown schematically in one location within the engine 10; a profile ignition pickup signal (PIP) from Hall effect sensor 118 (or other type) coupled to crankshaft 40; the throttle position (TP) from a throttle position sensor, as discussed; and absolute manifold pressure signal, MAP, from sensor 122, as discussed. Engine speed signal, RPM, may be generated by controller 12 from signal PIP. Manifold pressure signal MAP from a manifold pressure sensor may be used to provide an indication of vacuum, or pressure, in the intake manifold 44. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft 40. In some examples, storage medium read-only memory 106 may be programmed with computer readable data representing instructions executable by processor 102 for performing the methods described below as well as other variants that are anticipated but not specifically listed.

Engine 10 may further include a compression device such as a turbocharger or supercharger including at least a compressor 60 arranged along intake manifold 44. For a turbocharger, compressor 60 may be at least partially driven by a turbine 62, via, for example a shaft, or other coupling arrangement. The turbine 62 may be arranged along exhaust passage 48 and communicate with exhaust gasses flowing there-through. Various arrangements may be provided to drive the compressor. For a supercharger, compressor 60 may be at least partially driven by the engine and/or an electric machine, and may not include a turbine. Thus, the amount of compression provided to one or more cylinders of the engine via a turbocharger or supercharger may be varied by controller 12. In some cases, the turbine 62 may drive, for example, an electric generator 64, to provide power to a battery 66 via a turbo driver 68. Power from the battery 66 may then be used to drive the compressor 60 via a motor 70. Further, a sensor 123 may be disposed in intake manifold 44 for providing a BOOST signal to controller 12.

Further, exhaust passage 48 may include wastegate 26 for diverting exhaust gas away from turbine 62. In some embodiments, wastegate 26 may be a multi-staged wastegate, such as a two-staged wastegate with a first stage configured to control boost pressure and a second stage configured to increase heat flux to emission control device 78. Wastegate 26 may be operated with an actuator 150, which may be an electric actuator such as an electric motor, for example, though pneumatic actuators are also contemplated. Intake passage 42 may include a compressor bypass valve 27 configured to divert intake air around compressor 60. Wastegate 26 and/or compressor bypass valve 27 may be controlled by controller 12 via actuators (e.g., actuator 150) to be opened when a lower boost pressure is desired, for example.

Intake passage 42 may further include charge air cooler (CAC) 80 (e.g., an intercooler) to decrease the temperature of the turbocharged or supercharged intake gasses. In some embodiments, charge air cooler 80 may be an air to air heat exchanger. In other embodiments, charge air cooler 80 may be an air to liquid heat exchanger.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor (not shown) may be arranged within the EGR passage and may provide an indication of one or more of pressure, temperature, and concentration of the exhaust gas. Alternatively, the EGR may be controlled through a calculated value based on signals from the MAF sensor (upstream), MAP (intake manifold), MAT (manifold gas temperature) and the crank speed sensor. Further, the EGR may be controlled based on an exhaust $O_2$ sensor and/or an intake oxygen sensor (intake manifold). Under some conditions, the EGR system may be used to regulate the temperature of the air and fuel mixture within the combustion chamber. FIG. 1 shows a high pressure EGR system where EGR is routed from upstream of a turbine of a turbocharger to downstream of a compressor of a turbocharger. In other embodiments, the engine may additionally or alternatively include a low pressure EGR system where EGR is routed from downstream of a turbine of a turbocharger to upstream of a compressor of the turbocharger.

FIG. 2 shows a direct injection engine system 200, which may be configured as a propulsion system for a vehicle. The engine system 200 includes an internal combustion engine 202 having multiple combustion chambers or cylinders 204. Engine 202 may be engine 10 of FIG. 1, for example. Fuel can be provided directly to the cylinders 204 via in-cylinder direct injectors 206. As indicated schematically in FIG. 2, the engine 202 can receive intake air and exhaust products of the combusted fuel. The engine 202 may include a suitable type of engine including a gasoline or diesel engine.

Fuel can be provided to the engine 202 via the injectors 206 by way of a fuel system indicated generally at 208. In this particular example, the fuel system 208 includes a fuel storage tank 260 for storing the fuel on-board the vehicle, a lower pressure fuel pump 282 (e.g., a fuel lift pump), a higher pressure fuel pump 214, an accumulator 215, a fuel rail 216, and various fuel passages 218 and 220. In the example shown in FIG. 2, the fuel passage 218 carries fuel from the lower pressure fuel pump 282 to the higher pressure fuel pump 214, and the fuel passage 220 carries fuel from the higher pressure fuel pump 214 to the fuel rail 216.

As shown in FIG. 2, fuel storage tank 260 may comprise a saddle-type fuel tank, wherein a partition 276 within fuel storage tank 260 at least partially fluidly isolates a volume of fuel from the fuel lift pump. As depicted in FIG. 2, partition 276 may include any type of baffle, wall, or barrier including other types of protrusions from the bottom of the fuel storage tank 260. As such, partition 276 can divide fuel storage tank 260 into two storage sumps, a main fuel sump 280 and a secondary fuel sump 270. Although not explicitly shown in FIG. 2, secondary fuel sump 270 and main fuel sump 280 may be refilled using standard fuel refilling procedures. In one example, fuel may fill main fuel sump 280 before secondary fuel sump 270 is filled. Main fuel sump 280 is shown in FIG. 2 to have a larger volume than secondary fuel sump 270, however in other examples, they may have the same volume, or secondary fuel sump 270 may have a larger volume than main fuel sump 280. Fuel storage tank 260 may include fuel level sensor 262 which may measure and transmit the fuel levels in one or more fuel sumps (e.g., main fuel sump fuel level 281, secondary fuel sump fuel level 271) to the controller 222 via signal 264.

Lower pressure fuel pump 282 may be submerged in liquid fuel inside fuel reservoir 285 (which may also be referred to as a main jet pump fuel reservoir), which may be positioned in main fuel sump 280. Fuel reservoir 285 may comprise a small fraction of the total volume of main fuel sump 280. In this manner lower pressure fuel pump 282 may be kept submerged with a smaller volume of fuel as compared to if lower pressure fuel pump 282 was positioned in the main fuel sump 280 without fuel reservoir 285. Maintaining lower pressure fuel pump 282 submerged in fuel within fuel reservoir 285 aids in reducing suction loss of the lower pressure fuel pump 282 (e.g., cavitation) and maintaining DI pump performance and fuel flow to the engine. For example, if the fuel reservoir fuel level 291 drops below the suction port of the lower pressure fuel pump 282, air may be sucked into the fuel line and may destabilize engine operation. Fuel reservoir 285 may also mitigate cavitation or loss of suction to the lower pressure fuel pump 282 caused by fuel slosh during vehicle motion.

A fuel reservoir fuel level sensor 266 may be used to measure the fuel reservoir fuel level 291 and may communicate fuel reservoir fuel level 291 to controller 222 via signal 268. The fuel reservoir 285 is full when the fuel level inside the reservoir is at the level of the reservoir lip, the filled fuel reservoir level 287. When the fuel reservoir fuel level 291 is at the filled fuel reservoir level 287, additional fuel flowing to fuel reservoir 285 overflows to main fuel sump 280. Furthermore, when main fuel sump level 281 is greater than the filled fuel reservoir level 287, the fuel reservoir will be full, and fuel reservoir fuel level 291 is the filled fuel reservoir level 287. In one example, the filled fuel reservoir level 287 may be 100 mm. In other words, the fuel reservoir 285 may be 100 mm deep. In some examples, fuel reservoir fuel level 291 may be estimated via a reservoir-filling model taking into account one or more of fuel injection flow rate, fuel consumption rate, engine load, fuel/air ratio, and other engine operation variables. When the fuel reservoir fuel level 291 is measured or estimated to be low, various control measures as described in further detail below may be performed to mitigate cavitation of low pressure fuel pump to reduce a risk of fuel rail pressure drops leading to engine stalling.

The lower pressure fuel pump 282 can be operated by a controller 222 (e.g., controller 12 of FIG. 1) to provide fuel to higher pressure fuel pump 214 via fuel passage 218. The lower pressure fuel pump 282 can be configured as what may be referred to as a fuel lift pump. As one example, lower pressure fuel pump 282 may be a turbine (e.g., centrifugal) pump including an electric (e.g., DC) pump motor, whereby the pressure increase across the pump and/or the volumetric flow rate through the pump may be controlled by varying the electrical power (e.g., current and/or voltage) provided to the pump motor, thereby increasing or decreasing the motor speed. For example, as the controller 222 reduces the electrical power that is provided to lower pressure fuel pump 282, the volumetric flow rate and/or pressure increase across the pump 282 may be reduced. The volumetric flow rate and/or pressure increase across the pump may be increased by increasing the electrical power that is provided to the lower pressure fuel pump 282. As one example, the electrical power supplied to the lower pressure pump motor can be obtained from an alternator or other energy storage device on-board the vehicle (not shown), whereby the control system can control the electrical load that is used to power the lower pressure fuel pump 282. Thus, by varying the voltage and/or current provided to the lower pressure fuel pump 282, as indicated at 224, the flow rate and pressure of the fuel provided to higher pressure fuel pump 214 and ultimately to the fuel rail 216 may be adjusted by the controller 222. In addition to providing injection pressure for direct injectors 206, lower pressure fuel pump 282 may provide injection pressure for one or more port fuel injectors (not shown in FIG. 2) in some implementations.

Lower pressure fuel pump 282 may be fluidly coupled to a filter 286, which may remove small impurities that may be contained in the fuel that could potentially damage fuel handling components. One or more check valves 295 may impede fuel from leaking back upstream of the valves. In this context, upstream flow refers to fuel flow traveling from fuel rail 216 towards low-pressure pump 282 while downstream flow refers to the nominal fuel flow direction from the low-pressure pump towards the fuel rail.

A portion of fuel pumped from lower pressure fuel pump 282 may pass through check valve 295 and be delivered to accumulator 215 via low-pressure fuel passage 218. A remaining portion of fuel pumped from lower pressure fuel pump 282 may remain in fuel tank 260, flowing to main fuel sump 280 via orifice 290 and fuel passage 292, or flowing back to the fuel reservoir 285 via orifice 254 positioned in fuel passage 250. Orifice 290 may act as an ejector or a jet pump whereby fuel flowing through orifice 290 (e.g., transfer jet pump 290) to fuel passage 292 is accelerated through the orifice creating vacuum in fuel passage 274. Accordingly, if the fuel flow rate through orifice 290 is sufficiently high, fuel may be suctioned from secondary fuel sump 270 via filter 272 and fuel passage 274 to fuel passage 292. Fuel passage 274 may also include a check valve 275 (e.g., an anti-siphon check valve) to direct fuel flow in the direction from fuel passage 274 to orifice 290 and to fuel passage 292. As shown in FIG. 2, fuel passage 292 directs fuel flow to the fuel reservoir 285.

Orifice 254 may act as an ejector or a jet pump whereby fuel flowing through orifice 254 (e.g., main jet pump 254) to fuel passage 250 is accelerated through the orifice creating vacuum in fuel passage 256. Accordingly, if the fuel flow rate through orifice 254 is sufficiently high, fuel may be suctioned from main fuel sump 280 via fuel passage 256 to fuel passage 250. Fuel passage 256 may also include a check valve 258 (e.g., an anti-siphon check valve) to limit fuel flow in the direction from fuel passage 250 to orifice 254 and to fuel passage 292.

Fuel flow through the transfer jet pump 290 and through the main jet pump 254 can aid in keeping the fuel reservoir 285 filled by suctioning fuel from the main fuel sump 280. Transfer jet pump 290 may be referred to as a pull-type transfer jet pump since fuel flow through the jet pump 290 "pulls" fluid from the secondary fuel sump 270 to the fuel reservoir 285.

The higher pressure fuel pump 214 can be controlled by the controller 222 to provide fuel to the fuel rail 216 via the fuel passage 220. As one non-limiting example, higher pressure fuel pump 214 may be a BOSCH HDP5 HIGH PRESSURE PUMP, which utilizes a flow control valve (e.g., fuel volume regulator, solenoid valve, etc.) 226 to enable the control system to vary the effective pump volume of each pump stroke, as indicated at 227. However, it should be appreciated that other suitable higher pressure fuel pumps may be used. The higher pressure fuel pump 214 may be mechanically driven by the engine 202 in contrast to the motor driven lower pressure fuel pump 282. A pump piston 228 of the higher pressure fuel pump 214 can receive a mechanical input from the engine crank shaft or cam shaft via a cam 230. In this manner, higher pressure fuel pump 214 can be operated according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222. In some examples, higher pressure fuel pump 214 may supply sufficiently high fuel pressure to injectors 206. As injectors 206 may be configured as direct fuel injectors, higher pressure fuel pump 214 may be referred to as a direct injection (DI) fuel pump.

As previously described, maintaining lower pressure fuel pump 282 submerged in fuel within fuel reservoir 285 aids in reducing suction loss of the lower pressure fuel pump 282 (e.g., cavitation) and maintaining DI pump performance and fuel flow to the engine. For example, if the fuel reservoir fuel level 291 drops below the suction port of the lower pressure fuel pump 282, air may be sucked into the fuel line and may destabilize engine operation. DI pump performance may be monitored by estimating or measuring a DI pump volumetric efficiency. For example, a DI pump model may compute an expected DI pump volumetric flow rate and compare the expected DI pump volumetric flow rate to the commanded pump volumetric flow rate. A difference between the expected DI pump volumetric flow rate and the commanded pump volumetric flow rate may be computed as a lost DI pump volumetric fuel flow rate. A DI pump volumetric efficiency may then be computed by normalizing the lost DI pump volumetric fuel flow rate by the DI pump volumetric fuel flow rate when the DI pump is commanded to 100% and has a 100% volumetric efficiency (e.g., 100% nominal DI pump flow). Thus, the DI pump volumetric efficiency may be a measure of the DI pump volumetric efficiency loss. Accordingly, at lower DI pump volumetric efficiencies, the DI pump may be cavitating and sucking fuel vapor and/or air instead of liquid fuel. Lower DI pump volumetric efficiencies may be raised by increasing fuel line pressure to the DI pump, for example, by increasing the electrical energy supplied to the lift pump (e.g., raising lift pump voltage). For example, if the DI pump volumetric efficiency decreases by more than 15% from the 100% nominal DI pump flow, the DI pump may be determined to be operating at a low DI pump volumetric efficiency. Responsive to the low DI volumetric pump efficiency, the lift pump voltage may be increased. For example, responsive to the low DI volumetric pump efficiency, the lift pump voltage may be increased to a high threshold voltage, $V_{High,TH}$. As another example, responsive to the low DI volumetric pump efficiency, the lift pump voltage may be pulsed to a high threshold voltage and then incremented by a threshold incremental voltage, as described herein.

FIG. 2 depicts the optional inclusion of accumulator 215, introduced above. When included, accumulator 215 may be positioned downstream of lower pressure fuel pump 282 and upstream of higher pressure fuel pump 214, and may be configured to hold a volume of fuel that reduces the rate of fuel pressure increase or decrease between fuel pumps 282 and 214. The volume of accumulator 215 may be sized such that engine 202 can operate at idle conditions for a predetermined period of time between operating intervals of lower pressure fuel pump 282. For example, accumulator 215 can be sized such that when engine 202 idles, it takes 15 seconds to deplete pressure in the accumulator to a level at which higher pressure fuel pump 214 is incapable of maintaining a sufficiently high fuel pressure for fuel injectors 206. Accumulator 215 may thus enable an intermittent operation mode of lower pressure fuel pump 282 described below. In other embodiments, accumulator 215 may inherently exist in the compliance of fuel filter 286 and fuel passage 218, and thus may not exist as a distinct element.

The controller 222 can individually actuate each of the injectors 206 via a fuel injection driver 236. The controller 222, the driver 236, and other suitable engine system controllers can comprise a control system. While the driver 236 is shown external to the controller 222, it can be appreciated that in other examples, the controller 222 can include the driver 236 or can be configured to provide the functionality of the driver 236. Controller 222 may include additional components not shown, such as those included in controller 12 of FIG. 1.

Fuel system 208 includes a low pressure (LP) fuel pressure sensor 231 positioned along fuel passage 218 between fuel lift pump 282 and higher pressure fuel pump 214. In this configuration, readings from sensor 231 may be interpreted as indications of the fuel pressure of fuel lift pump 282 (e.g., the outlet fuel pressure of the lift pump) and/or of the inlet pressure of higher pressure fuel pump 214. Signals from sensor 231 may be used to control the voltage applied to the lift pump in a closed-loop manner. Specifically, LP fuel pressure sensor 231 may be used to determine whether sufficient fuel pressure is provided to higher pressure fuel pump 214 so that the higher pressure fuel pump 214 ingests liquid fuel and not fuel vapor, and/or to minimize the average electrical power supplied to fuel lift pump 282. It will be understood that in other embodiments in which a port-fuel injection system, and not a direct injection system, is used, LP fuel pressure sensor 231 may sense both lift pump pressure and fuel injection. Further, while LP fuel pressure sensor 231 is shown as being positioned upstream of accumulator 215, in other embodiments the LP sensor may be positioned downstream of the accumulator.

As shown in FIG. 2, the fuel rail 216 includes a fuel rail pressure sensor 232 for providing an indication of fuel rail pressure to the controller 222. An engine speed sensor 234 can be used to provide an indication of engine speed to the controller 222. The indication of engine speed can be used to identify the speed of higher pressure fuel pump 214, since the higher pressure fuel pump 214 is mechanically driven by the engine 202, for example, via the crankshaft or camshaft.

Controller 222 may determine a voltage to be applied to the lift pump based on the commanded fuel pressure, and the commanded fuel pressure may be dependent on an inferred or measured fuel temperature. The inferred or measured fuel temperature may infer the fuel pressure above which fuel vaporization, $P_{fuel,novap}$, in fuel system 208 can be averted. For example $P_{fuel,novap}$ may be greater than a calculated fuel vapor pressure, $P_{fuel,vap}$ by a threshold pressure differential, $P_{diffuelvap}$. In addition, the controller may compute a lift pump voltage to be applied based on the commanded lift pump pressure and the fuel flow rate. For example, during idle engine conditions, when a lift pump pressure to be applied based on the fuel flow rate may be lower than $P_{fuel,novap}$, the controller 12 may command a lift pump pressure of $P_{fuel,novap}$ in order to reduce a risk of fuel vaporization in fuel system 208. As another example, during high load engine conditions, when the lift pump pressure to be applied based on the fuel flow rate may be higher than $P_{fuelnovap}$, the controller 12 may command the lift pump pressure based on the fuel flow rate. $P_{fuel,vap}$ is dependent on the fuel temperature, such that at low fuel temperatures, $P_{fuel,vap}$ and hence $P_{fuel,novap}$, may be lower as compared to at high fuel temperatures where $P_{fuel,vap}$ and hence $P_{fuel,novap}$, may be higher. Accordingly, in another example, during cold fuel conditions, a lift pump pressure to be applied based on the fuel flow rate may be lower than $P_{fuelnovap}$. As such, controller 12 may command a lift pump pressure of $P_{fuel,novap}$ in order to reduce a risk of fuel vaporization in fuel system 208. In this manner, the lift pump operation may be controlled in a base mode, wherein the lift pump voltage (or pressure) is calculated based on the fuel flow rate, and wherein the commanded lift pump pressure is greater than $P_{fuel,novap}$ based on an inferred or measured fuel temperature.

As used herein, the lift pump pressure is taken to be synonymous with the high pressure (DI) pump inlet pressure. The controller may use testing data or modeled data, such as the data of FIGS. 5 and 6, to aid in determining the lift pump voltage. The relationship between lift pump voltage and other operating conditions such as lift pump pressure or testing and/or modeled data may also be stored in and retrieved from a look-up table upon query.

As elaborated with reference to the lift pump control scheme of FIGS. 8-10, in response to a DI pump efficiency being below a threshold volumetric efficiency, the controller 222 may override or deactivate the base mode control of the lift pump and operate the lift pump in a pulse and increment mode by increasing a lift pump voltage from the base mode commanded lift pump voltage to a $V_{High,TH}$. In one example, increasing the lift pump voltage to $V_{High,TH}$ may include pulsing the lift pump voltage to the $V_{High,TH}$. The pulse may be held at the $V_{High,TH}$ for a duration until the DI pump volumetric efficiency is restored to the threshold volumetric efficiency or higher. Following the pulsing of the lift pump voltage at $V_{High,TH}$, the lift pump voltage may be incremented by a threshold incremental voltage relative to the base mode commanded lift pump voltage prior to the pulsing. In this way, occasions for DI pump operation below the threshold efficiency can be reduced and robust engine operation can be increased.

Furthermore, as further elaborated herein below, controller 222 may operate the lift pump in a first control mode responsive to a main sump fuel level being less than a first threshold reservoir fuel level. For example, the lift pump may be operated in a first control mode in response to a fuel reservoir fuel level 291 being below a first threshold reservoir level or in response to a fuel tank level (e.g., main fuel sump level 281) being below a first threshold reservoir level. The first control mode may comprise maintaining a lift pump voltage above a first threshold voltage.

Furthermore, the lift pump may be operated in a second control mode in response to a fuel tank level (e.g. main fuel sump fuel level 281, or secondary fuel sump fuel level 271) being below a threshold fuel sump level, or in response to a fuel reservoir fuel level 291 being below a second threshold fuel reservoir level. The second control mode may comprise maintaining a lift pump voltage above a second threshold voltage greater than the first threshold voltage and less than the high threshold voltage, $V_{High,TH}$.

Further still, controller 222 may override or deactivate the pulse and increment mode and activate a third control mode in response to engine operating conditions crossing threshold conditions causing a fuel rail pressure drop detection time decreases below a threshold detection time. Further still, controller 222 may override or deactivate the first or second control modes and activate a third control mode in response to engine operating conditions crossing threshold conditions causing a fuel rail pressure drop detection time decreases below a threshold detection time. The third control mode may comprise increasing a lift pump voltage to a third threshold voltage greater than the second threshold voltage and less than the high threshold voltage, $V_{High,TH}$. Further still, controller 222 may override or deactivate the first or second control mode and activate the pulse and increment mode in response to the DI pump volumetric efficiency being below the threshold volumetric efficiency.

In this way, when the fuel reservoir fuel level or the fuel tank fuel levels are lower controller 222 may reduce a risk of fuel vaporization in the fuel system by maintaining the lift pump voltage (and a lift pump pressure) above a threshold level, thereby maintaining or increasing fuel flow rates through the fuel system jet pumps (e.g., main jet pump and transfer jet pump). Increased fuel flow rates through the fuel system jet pumps aids in replenishing and maintaining fuel levels in the fuel reservoir and the fuel tank. Furthermore, when the DI volumetric efficiency is lower, controller 222 may reduce a risk of cavitation at the DI pump by increasing or pulsing the lift pump voltage to the $V_{High,TH}$ and incrementing the lift pump voltage relative to the base control mode voltage. Further still, when the fuel rail pressure drop detection time is below a threshold detection time, controller 222 may reduce a risk of cavitation at the DI pump by increasing the lift pump voltage to a third threshold voltage.

In some cases, controller 222 may also determine an expected or estimated fuel rail pressure and compare the expected fuel rail pressure to the measured fuel rail pressure measured by fuel rail pressure sensor 232. In other cases, controller 222 may determine an expected or estimated lift pump pressure (e.g., outlet fuel pressure from fuel lift pump 282 and/or inlet fuel pressure into higher pressure fuel pump 214) and compare the expected lift pump pressure to the measured lift pump pressure measured by LP fuel pressure sensor 231. The determination and comparison of expected fuel pressures to corresponding measured fuel pressures may be performed periodically on a time basis at a suitable frequency or on an event basis. Although controller 222 outputs with respect to lift pump operation are described in terms of commanding the lift pump voltage, controller 222 may also output commands based on a lift pump pressure, either in the alternative or in combination with the lift pump voltage. Lift pump voltage and lift pump pressure are generally affinely correlated (for centrifugal lift pumps), and this affine correlated pump characterization may be precisely determined a priori. Furthermore, lift pump voltage and lift pump pressure increase with increasing lift pump fuel flow rate. Lift pump characterization data correlating lift pump pressure, lift pump voltage, and lift pump fuel flow rate may be stored in and accessed by controller 222 of FIG. 2 to inform control of fuel system 208—for example, a desired lift pump pressure may be fed to function 304 as an input so that a lift pump minimum voltage, whose application to fuel lift pump 282 achieves the desired lift pump pressure, may be obtained. It will be understood that the lift pump pressure minima and maxima may be bounded by fuel vapor pressure and a set-point pressure of a pressure relief valve, respectively. Further, analogous data sets and functions relating lift pump pressure to lift pump voltage may be obtained and accessed for lift pump types other than turbine lift pumps driven by DC electric motors, including but not limited to positive displacement pumps and pumps driven by brushless motors. Such functions may assume linear or non-linear forms.

Determination of the expected lift pump pressure may also account for operation of fuel injectors 206 and/or higher pressure fuel pump 214. Particularly, the effects of these components on lift pump pressure may be parameterized by the fuel flow rate—e.g., the rate at which fuel is injected by injectors 206, which may be equal to the lift pump flow rate under steady state conditions. In some implementations, a linear relation may be formed between lift pump voltage, lift pump pressure, and fuel flow rate. As a non-limiting example, the relation may assume the following form: $V_{LP}=C_1*P_{LP}+C_2*F+C_3$, where $V_{LP}$ is the lift pump voltage, $P_{LP}$ is the lift pump pressure, F is the fuel flow rate, and $C_1$, $C_2$, and $C_3$ are constants which may respectively assume the values of 1.481, 0.026, and 2.147. In this example, the relation may be accessed to determine a lift pump supply voltage whose application results in a desired lift pump pressure and fuel flow rate. The relation may be stored in (e.g., via a lookup table) and accessed by controller 222, for example.

The expected fuel rail pressure in fuel rail 216 may be determined based on one or more operating parameters—for example, one or more of an assessment of fuel consumption (e.g., fuel flow rate, fuel injection rate), fuel temperature (e.g., via engine coolant temperature measurement), and lift pump pressure (e.g., as measured by LP fuel pressure sensor 231) may be used.

As alluded to above, the inclusion of accumulator 215 in fuel system 208 may enable intermittent operation of fuel lift pump 282, at least during selected conditions. Intermittently operating fuel lift pump 282 may include turning the pump on and off, where during off periods the pump speed falls to zero, for example. Intermittent lift pump operation may be employed to maintain the efficiency of higher pressure fuel pump 214 at a desired level, to maintain the efficiency of fuel lift pump 282 at a desired level, and/or to reduce unnecessary energy consumption of fuel lift pump 282. The efficiency (e.g., volumetric) of higher pressure fuel pump 214 may be at least partially parameterized by the fuel pressure at its inlet; as such, intermittent lift pump operation may be selected according to this inlet pressure, as this pressure may partially determine the efficiency of higher pressure fuel pump 214. The inlet pressure of higher pressure fuel pump 214 may be determined via LP fuel pressure sensor 231, or may be inferred based on various operating parameters. The efficiency of higher pressure fuel pump 214 may be computed based on the rate of fuel consumption by engine 202, the fuel rail pressure change, and fraction of pump volume to be pumped. The duration for which fuel lift pump 282 is driven may be related to maintaining the inlet pressure of higher pressure fuel pump 214 above fuel vapor pressure, for example. On the other hand, fuel lift pump 282 may be deactivated according to the amount of fuel (e.g., fuel volume) pumped to accumulator 215; for example, the lift pump may be deactivated when the amount of fuel pumped to the accumulator exceeds the volume of the accumulator by a predetermined amount (e.g., 20%). In other examples, fuel lift pump 282 may be deactivated when the pressure in accumulator 215 or the inlet pressure of higher pressure fuel pump 214 exceed respective threshold pressures. In some implementations, the operating mode of fuel lift pump 282 may be selected according to the instant speed and/or load of engine 202. A suitable data structure such as shown in FIG. 7, or a lookup table, may store the operating modes which may be accessed by using engine speed and/or load as indices into the data structure, which may be stored on and accessed by controller 222, for example. The intermittent operating mode in particular may be selected for relatively lower engine speeds and/or loads. During these conditions, fuel flow to engine 202 is relatively low and fuel lift pump 282 has capacity to supply fuel at a rate that is higher than the engine's fuel consumption rate. Therefore, fuel lift pump 282 can fill accumulator 215 and then be turned off while engine 202 continues to operate (e.g., combusting air-fuel mixtures) for a period before the lift pump is restarted. Restarting fuel lift pump 282 replenishes fuel in accumulator 215 that was fed to engine 202 while the lift pump was off.

Figure 3:
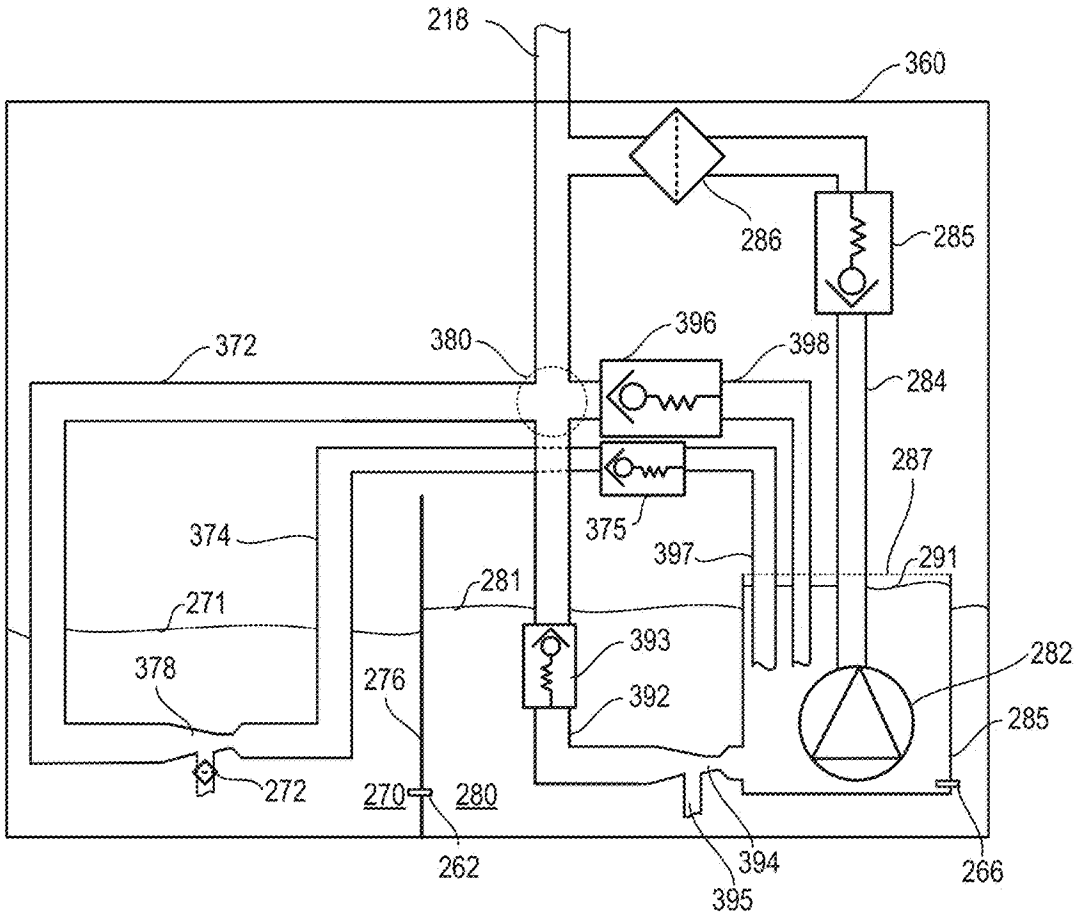
FIG. 3 shows another example fuel tank system.

Turning to FIG. 3, it illustrates another example fuel tank system 360, including a transfer jet pump 378 for pumping fuel from secondary fuel sump 270 to main fuel sump 280, and a main jet pump 394 for pumping fuel from main fuel sump 280 to fuel reservoir 285. In this way the main jet pump 394 and the transfer jet pump 378 aid in maintaining fuel reservoir fuel level 291. Although not shown in FIG. 3, a controller 222 may send and receive signals to and from fuel lift pump 282, and one or more fuel level sensors 262 and 266, respectively, for controlling the fuel reservoir fuel level 291.

In fuel tank system 360, fuel may be pumped by fuel lift pump 282, flowing through lift pump outlet 284, check valve 285, and filter 286, after which at least a portion of fuel flow may be directed through fuel passage 218 towards the fuel injection system (e.g., towards higher pressure fuel pump 214). Another portion of the fuel flow may be directed to fuel passage junction 380, where fuel may then flow through fuel passage 372 to the secondary fuel sump 270, through fuel passage 392 to main fuel sump 280, or via relief valve 396 to fuel passage 398. Fuel passage junction 380 may be structured to bias fuel flow to fuel passage junction 380 to one or more of fuel passages 372, 392, or 398. Further still, additional check valves and relief valves may be used (e.g., in addition to relief valve 396), in fluid connection with fuel passage junction 380 to bias fuel flow in one or more of fuel passages 372, 392, and 398. The relative orientation and sizing of fuel passages in FIG. 3 are for illustrative purposes only and the actual relative orientation and sizing of fuel passages may differ.

Fuel flowing through fuel passage 372 is directed to secondary fuel sump 270 and through the orifice of transfer jet pump 378. In this way, fuel flow through fuel passage 372 may entrain fuel from secondary fuel sump 270. Entrained fuel by transfer jet pump 378 may first pass through a fuel filter 272 prior to entering the orifice of transfer jet pump 378 and being directed to fuel passage 374. As fuel flow rate through fuel passage 372 increases, transfer jet pump 378 entrains higher flow rates of fuel from secondary fuel sump 270. Fuel from fuel passage 374 flows to fuel reservoir 285 in the main fuel sump 280. Check valve 375 prevents siphoning or reverse flow of fuel from the fuel reservoir 285 back to fuel passage 374 and jet pump 378. In this manner, the transfer jet pump 378 aids in maintaining the fuel reservoir fuel level 291. As the fuel flow rate in fuel passage 372 decreases, the pressure drop arising from flow through the orifice of transfer jet pump 378 decreases such that for very small flow rates, there may not be enough suction through fuel filter 272 to entrain fuel from secondary fuel sump 270. In other words, at very small fuel flow rates in fuel passage 372, the transfer jet pump performance may be degraded. Transfer jet pump 378 may be referred to as a push-type transfer jet pump since fuel flow "pushes" fuel from secondary fuel sump 270 to the fuel reservoir 285.

Fuel flowing through fuel passage 392 is directed to main fuel sump 280 and through the orifice of main jet pump 394. In this way, fuel flow through fuel passage 372 may entrain fuel from main fuel sump 280. Fuel is entrained by main jet pump 394 via fuel passage 395, which may include a fuel filter, prior to entering the orifice of main jet pump 394 and being directed to fuel reservoir 285. As fuel flow rate through fuel passage 392 increases, main jet pump 394 entrains higher flow rates of fuel from main fuel sump 280. In this manner, the main jet pump 394 aids in maintaining the fuel reservoir fuel level 291. As the fuel flow rate in fuel passage 392 decreases, the pressure drop arising from flow through the orifice of main jet pump 394 decreases such that for very small flow rates, there may not be enough suction through fuel passage 395 to entrain fuel from main fuel sump 280. In other words, at very small fuel flow rates in fuel passage 392, the main jet pump performance may degrade. Check valve 393 prevents siphoning or reverse flow of fuel from fuel reservoir 285 to fuel passage 292.

In this manner, the transfer jet pump 378 and the main jet pump 394 may transfer fuel from the secondary fuel sump 270 and the main fuel sump 280, respectively, to the fuel reservoir 285, thereby making fuel from both sumps available to be pumped by the lift pump 282.

Transfer jet pump 378 and main jet pump 394 are capable of transferring all the fuel in the secondary fuel sump 270 and the main fuel sump 280, respectively. For example, when the jet pump pressure (e.g., the lift pump pressure) is sufficiently high the jet pumps (main jet pump 394 and transfer jet pump 378) may pump fuel at a flow rate greater than the engine fuel consumption rate (e.g., fuel injection flow rate), thereby keeping the fuel reservoir 285 filled (e.g., fuel reservoir fuel level 291 is at the filled fuel reservoir level 287). As an example, the jet pump and lift pump pressures being sufficiently high may include the jet pump and lift pump pressures being greater than a threshold pressure. In one example, the threshold pressure may include 200 kPa. At lower jet pump pressures less than the threshold pressure, the jet pump fuel flow rate may be less than the engine fuel consumption rate (e.g., fuel injection flow rate) and the fuel reservoir fuel level 291 may decrease and may not be maintained at the filled fuel reservoir level 287. Accordingly, under certain operating conditions such as cold fuel conditions, the lift pump pressure and jet pump pressures may not be sufficient to maintain the fuel reservoir fuel level (e.g., jet pump performance may degraded at low lift pump pressures). As such, during conditions when jet pump performance may be degraded, and when the fuel tank (e.g., main sump) fuel level or the fuel reservoir fuel levels are lower (thus increasing a risk of lift pump cavitation and reduced engine robustness), lift pump control modes may be activated, as described herein, to increase electrical energy delivered to the lift pump. By increasing electrical energy to the lift pump, the lift pump pressure may be increased to a sufficiently high level (e.g., greater than a threshold pressure) such that jet pump performance is restored, and fuel levels in the fuel tank and the fuel reservoir may be replenished. In this way, the risk of lift pump cavitation may be reduced, thereby increasing engine robustness.

In the event of higher lift pump pressures, a portion of the returning fuel at fuel passage junction 380 may be directed through fuel passages 372 and 392 as well as through relief valve 396. Fuel flowing through relief valve 396 is directed to fuel passage 398, and then back to fuel reservoir 285. In this way, higher lift pump pressures may be employed to more quickly replenish fuel reservoir 285 since fuel flow via fuel passage junction 380 will activate both main and transfer jet pumps 394 and 378 respectively, thereby transferring fuel from both the main and secondary fuel sumps to fuel reservoir 285. In addition, excess fuel flow (e.g., fuel not directed to fuel passage 218 or through the jet pumps) will be returned to the fuel reservoir 285.

Figure 4:
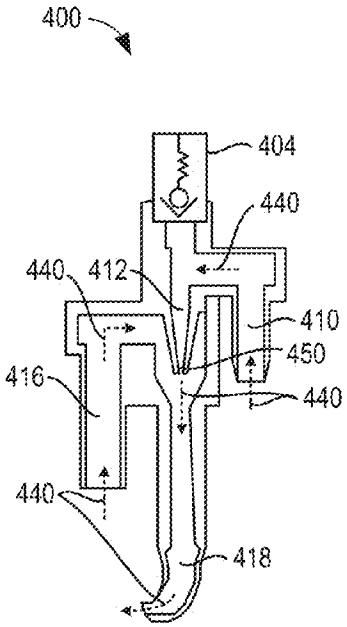
FIG. 4 shows an example of a jet pump.

Turning now to FIG. 4, it shows an example configuration of a jet pump 400. Jet pumps depicted in FIGS. 2, 3, and 5 and described herein may include the structural features of jet pump 400. Arrows 440, show the direction of fuel flow through jet pump 400. As described above in relation to FIGS. 2 and 3, a portion of the fuel flow directed from fuel lift pump 282 may be directed to jet pumps (e.g., main jet pumps 394 and 594, or transfer jet pumps 378 and 290) in the fuel tank fuel sumps. The fuel directed from fuel lift pump 282 may enter the jet pumps at inlet fuel passage 410, where it is redirected to orifice inlet 412. Upstream from orifice inlet 412, a pressure relief valve 404 may be used to bleed fuel flow in the case where the fuel pressure in the jet pump (or the fuel pressure in the lift pump which supplies the jet pump) is very high. Fuel at orifice inlet 412 is accelerated as it flows through the orifice nozzle 450 into orifice outlet fuel passage 418, thereby creating a vacuum in fuel passage 416. The suction created by the accelerating fuel through the jet pump orifice entrains and "pumps" fuel fluidly connected to fuel passage 416 into the jet pump fuel passage 418. As fuel flow rates through inlet fuel passage 410 are increased, a larger pressure difference (e.g., vacuum) in fuel passage 416 may be generated, thereby entraining higher flow rates of fuel fluidly connected to fuel passage 416 into the jet pump fuel passage 418. At very low fuel flow rates through inlet fuel passage 410, a very low pressure difference (e.g., vacuum) in fuel passage 416 may be generated, thereby entraining lower or no flow of fuel fluidly connected to fuel passage 416 into the jet pump fuel passage 418. Fuel passage 416 may be fluidly connected to a fuel source such as the main fuel sump 280 or the secondary fuel sump 270. Fuel flow through the jet pump orifice nozzle 450 may be larger for larger nozzles and smaller for smaller nozzles, given the same fuel flow pressure (e.g., given the same lift pump pressure).

Figure 5:
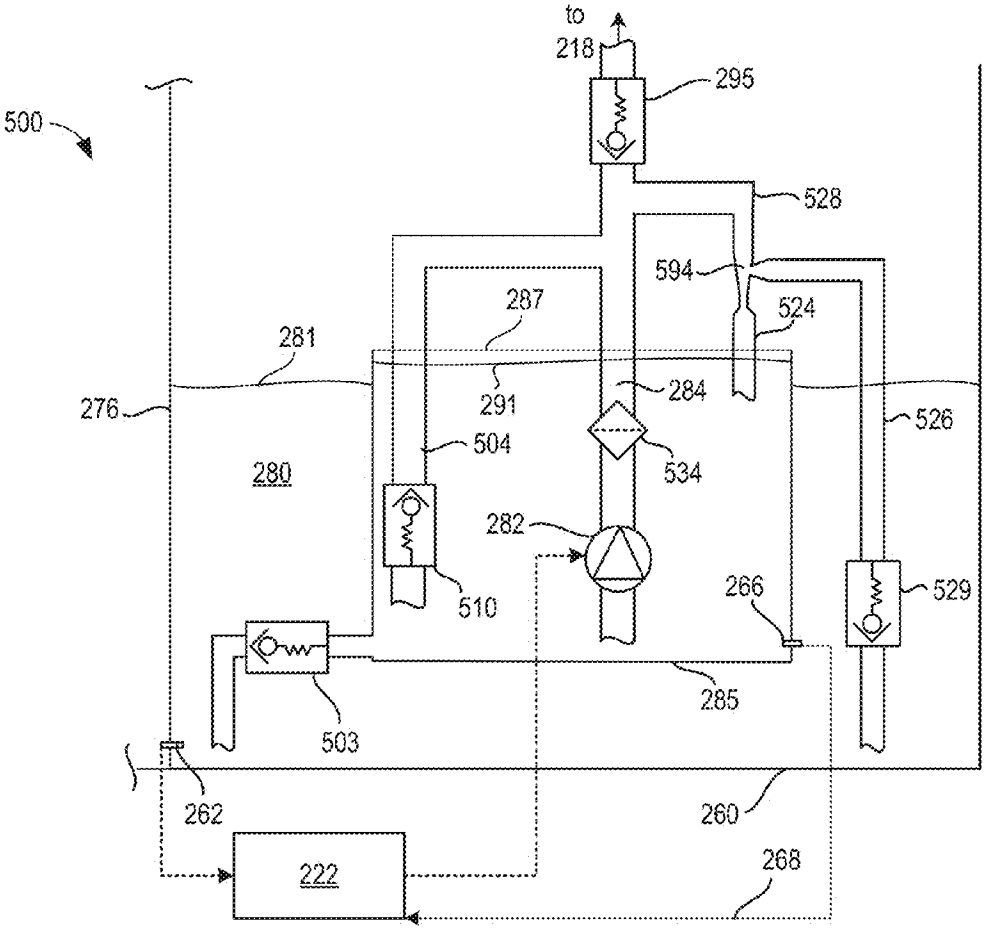
FIG. 5 shows an example of a main jet pump configuration of a fuel tank system.

Turning now to FIG. 5, it illustrates another example configuration of a main jet pump 594 of a fuel tank system 500, including main fuel sump 280 and fuel reservoir (e.g., main jet pump fuel reservoir) 285. Although not shown, fuel tank system may include a secondary fuel sump separated by partition 276 from main fuel sump 280, as shown in FIG. 2. Fuel may enter the fuel reservoir 285 by overflow from the main fuel sump 280 when the main fuel sump fuel level 281 is higher than the filled fuel reservoir fuel level 287. Fuel may enter the fuel reservoir 285 via check valve 503 from the head pressure differential between the main fuel sump 280 and the fuel reservoir 285. When the fuel reservoir fuel level 291 is less than the main fuel sump fuel level 281, this head pressure equalization between the main fuel sump 280 and the fuel reservoir 285 may fill the fuel reservoir 285 to the main fuel sump fuel level 281.

Fuel pumped by the lift pump 282 may also flow to fuel passage 528 and through orifice 594 (e.g., main jet pump). As fuel flow is accelerated through orifice 594, suction is created in fuel passage 526, and fuel is pumped from the main fuel sump 280 through fuel passage 526 to the fuel reservoir 285. An anti-siphon check valve 529 may be positioned in fuel passage 526 to prevent siphoning of fuel from the reservoir back to the main fuel sump 280, for example when the lift pump is off.

Fuel pumped from the fuel reservoir 285 may flow through the filter 534 and through the outlet check valve 295 via fuel passage 284. In the case of over-pressure, fuel is relieved through the pressure relief valve 510, returning fuel via fuel passage 504 to the fuel reservoir. During over-pressure, some fuel may also be forced through the jet pump, creating suction which may draw fuel from the main fuel sump 280 into the fuel reservoir 285. The main jet pump suction fuel passage 526 may draw from the bottom of the main fuel sump 280. In other examples, the main jet pump fuel passage 526 may draw fuel from another sump within the fuel tank, or from another fuel tank.

Fuel passage 524 is fluidly connected to fuel reservoir 285. In this way, the lift pump pressure induced fuel flow can be used to activate the main jet pump 594 for transferring fuel from the main fuel sump 280 to the fuel reservoir 285. As described above for jet pump operation in FIGS. 2-3, as the lift pump pressure and the resulting fuel flow is increased, fuel flow from the main fuel sump 280 to the fuel reservoir 285 via main jet pump 594 is increased. If the lift pump pressure is very low, the resulting fuel flow may be small such that fuel flow from the main fuel sump 280 to the fuel reservoir 285 via main jet pump 594 is very small or there may be not be sufficient vacuum to transfer fuel to the fuel reservoir 285 from the main fuel sump 280.

Turning now to FIG. 6, it illustrates a graph with trend line 610 showing the relationship between jet pump net flow rate (e.g., jet pump suction flow rate) and lift pump pressure, which is typically the jet pump pressure. As described above, jet pump flow decreases as the lift pump pressure decreases. In order to maintain fuel levels in the fuel reservoir, the jet pump flow rate may be maintained greater than the fuel injection flow rate. For example, if the fuel injection flow rate is 10 cc/sec, the jet pump pressure (e.g., the lift pump pressure) is maintained at least 100 kPa gauge, to maintain fuel reservoir fuel level, especially for the case when the fuel reservoir fuel level is low. As such, during periods when the lift pump is off, or when the lift pump duty cycle is low (e.g., low lift pump voltage, low lift pump pressure, long duration between lift pump pulsing, and the like) jet pump flow may be reduced. Furthermore, when the jet pump flow is reduced, the jet pump suction flow rate may be less than the fuel injection flow rate. Thus, the fuel reservoir fuel level 291 may decrease and can result in cavitation of the lift pump, drastic drops in fuel rail pressure, and engine stalling. Thus, as described herein, increasing the lift pump voltage responsive to a fuel tank or fuel reservoir fuel level being below a threshold fuel level can aid in mitigating lift pump cavitation and reduce engine stalling by increasing fuel flow through the jet pump (e.g., fuel flow transferred from the fuel tank fuel sumps to the fuel reservoir).

Turning now to FIG. 7, it illustrates a plot 700 of Time for Fuel Rail Pressure (FRP) to drop 50 bar data and a plot 702 of volumetric fuel injection flow rate data as a function of DI pump command (or DI pump duty cycle) and engine speed. 710 and 740 are data lines of constant DI pump command at 80% DI pump duty cycle, and 730 and 760 are data lines of constant engine speed at 3000 rpm. Thus, regions of plots 700 and 702 above data lines 710 and 740 are regions where the DI pump duty cycle is greater than 80%, and regions of plots 700 and 702 to the right of data lines 730 and 760 are regions where the engine speed is greater than 3000 rpm. 720 represents a data boundary where the time for FRP to drop to drop by a threshold pressure drop (e.g., 50 bar) is 100 ms, and 750 represents a data boundary where the fuel injection flow rate is 4 cc/s. Thus, regions above data boundary 720 represent regions where the time for FRP to drop 50 bar is less than 100 ms, and regions above data boundary 750 represent regions where the volumetric fuel injection flow rate is greater than 4 cc/s. When the volumetric fuel injection flow rate is greater than 4 cc/s, FRP may drop 50 bar in less than 100 ms.

A time for detecting and responding to fuel vaporization within the fuel system (e.g., detection and responding to a DI pump volumetric efficiency being below a threshold volumetric efficiency), may not be instantaneous and may respond after a threshold time interval, $t_{FRP}$, due to the non-instantaneous fuel pressure dynamics in the fuel system fuel passages, fuel pressure sensor response times, controller computation speed and response time, and the like. In one example, $t_{FRP}$ may be 100 ms. For example, for a case where the DI pump efficiency is zero, a fuel pressure drop of 50 bar may not be detected until after a threshold time interval, 100 ms, has elapsed following the fuel pressure drop. In other examples, the threshold pressure drop may be greater than 50 bar or less than 50 bar. For example, in vehicle systems where the threshold time interval is less than 100 ms, the threshold pressure drop may be greater than 50 bar, while in vehicle systems where the threshold time interval is greater than 100 ms, the threshold pressure drop may be less than 50 bar. Accordingly, controller 222 may operate lift pump in a third control mode by increasing a lift pump voltage to a third threshold voltage responsive to engine operating conditions during which a drop in FRP of 50 bar may occur in less than the threshold time interval. By increasing the lift pump voltage to the third threshold voltage, the risk of a drop in FRP of 50 bar in less than 100 ms may be reduced.

The 80% DI pump duty cycle corresponds to a threshold DI pump duty cycle at which the FRP can be maintained or increased, by increasing a lift pump voltage to a third threshold voltage, in order to reduce a risk of FRP drop (e.g. of 50 bar in less than 100 ms). Above the threshold DI pump duty cycle, the available control action for mitigating an FRP drop of 50 bar in less than 100 ms because the DI pump duty cycle cannot be increased above 100%. The 3000 rpm engine speed corresponds to a threshold engine speed above which engine operation may be rare. In this manner, fuel economy and jet pump operation can be maintained at engine speeds less than 3000 rpm, while engine robustness may be prioritized at engine speeds greater than 3000 rpm by increasing the lift pump voltage to a third threshold voltage.

In this manner, shaded region 770 of plot 700 illustrates engine operating conditions where DI pump duty cycle is greater than 80%, engine speed is greater than 3000 rpm, or time for FRP to drop 50 bar is less than 100 ms, whereas shaded region 780 of plot 702 illustrates engine operating conditions where DI pump duty cycle is greater than 80%, engine speed is greater than 3000 rpm, or volumetric fuel injection flow rate is greater than 4 cc/s. The data of plots 700 and 702 may be stored in controller 222 in the form of a lookup table, set of equations, or other suitable form. As such, controller 222 may reference the data during engine operation and perform actions based on current, past, or predicted future operating conditions. For example, controller 222 may increase a fuel lift pump voltage above a third threshold voltage in response to the engine speed being greater than 3000 rpm, or in response to engine operating conditions falling in shaded region 770, in order to mitigate an FRP drop of 50 bar occurring in less than 100 ms, thereby increasing engine robustness and decreasing engine stalling. Similarly, controller 222 may increase a fuel lift pump voltage above a third threshold voltage in response to the engine speed being greater than 3000 rpm, or in response to engine operating conditions falling in shaded region 780, in order to mitigate a volumetric fuel injection flow rate decreasing below 4 cc/s, thereby increasing engine robustness and decreasing engine stalling.

Turning now to FIGS. 8-10, they illustrate flow charts for methods 800, 900, 902, and 1000, for operating a fuel lift pump for reducing engine stalling while maintaining or increasing DI pump efficiency. Instructions for carrying out methods 800, 900, 902, 1000, and other methods included herein, may be executed by a controller (e.g., controller 12, or 222) based on instructions stored on a memory of the controller and in conjunction with signals received from sensors of the engine system, such as the sensors described above with reference to FIGS. 1-3 and 5, and signals sent to various actuators of the engine system, such as signal 224 to operate lift pump 282. The controller may employ engine actuators of the engine system to adjust engine operation, according to the methods described below.

Method 800 begins at 810 where vehicle operating conditions such as engine speed, DI pump duty cycle, fuel injection flow rate, vehicle speed, fuel reservoir level, fuel tank sump levels, and the like, are estimated and/or measured. At 822 method 800 begins a third control mode 826 for the lift pump by determining if an FRP detection time condition is met.

Turning briefly to FIG. 10, it illustrates a method 1000 for evaluating if an FRP detection time condition is met. The FRP detection time condition refers to engine operating conditions at which a risk of a precipitous FRP drop leading to engine stalling may be high, such that the time to detect and respond to low DI pump efficiency or low fuel tank levels (e.g., first or second fuel level conditions), which may cause low DI pump efficiencies and engine stalls, may be greater than the time for the FRP pressure to drop. In other words, when the FRP detection time condition is met, controller 222 may proactively respond by operating lift pump in a manner that mitigates the risk of a precipitous FRP drop. Method 1000 may refer to a lookup table, equation, or other data structure as illustrated in the plots 700 and 702, when determining if an FRP detection time condition is met according to engine operating conditions.

Method 1000 begins at 1010 where it determines if a DI pump duty cycle, $DC_{DI}$, is greater than a threshold DI pump duty cycle, $DC_{DI,TH}$. $DC_{DI,TH}$ may correspond to the $DC_{DI}$ above which the DI pump may be incapable of responding to a precipitous FRP drop causing engine stalling. As described above with reference to FIG. 7, $DC_{DI,TH}$ may be 80% (0.8 lift pump command). In other words if the DI pump duty cycle is greater than $DC_{DI,TH}$, then an FRP detection time condition is satisfied. If $DC_{DI}<DC_{DI,TH}$, method 1000 continues at 1020 where it determines if Engine Speed is greater than a threshold Engine Speed, Engine $Speed_{TH}$. Engine $Speed_{TH}$ may correspond to the Engine Speed above which a precipitous FRP drop causing engine stalling may occur. As described above with reference to FIG. 7, Engine $Speed_{TH}$ may be 3000 rpm. If Engine Speed<Engine $Speed_{TH}$, method 1000 continues at 1030 where it determines if a fuel injection flow rate, $Q_{inj,fuel}$, is greater than a threshold fuel injection flow rate, $Q_{inj,fuel,TH}$. $Q_{inj,fuel,TH}$ may correspond to the $Q_{inj,fuel}$ above which a precipitous FRP drop causing engine stalling may occur. As described above with reference to FIG. 7, $Q_{inj,fuel,TH}$ may be 4 cc/s. In other words if the injection fuel flow rate is greater than $Q_{inj,fuel,TH}$ then an FRP detection time condition is satisfied. If $Q_{inj,fuel}<Q_{inj,fuel,TH}$, method 1000 continues at 1040 where it determines if a time for FRP to drop 50 bar, $t_{FRP}$ is less than a threshold time for FRP to drop 50 bar, $t_{FRP,TH}$. $t_{FRP,TH}$ may correspond to a duration of time below which the controller 222 may not responsively operate lift pump quickly enough to mitigate a precipitous drop in fuel rail pressure (e.g., 50 bar pressure drop) such that an engine stall can be averted. As described above with reference to FIG. 7, $t_{FRP,TH}$ may be 100 ms. In other words, if engine operating conditions are such that $t_{FRP}$ is less than 100 ms (e.g., engine operating conditions fall within the shaded region 770, then an FRP detection time condition is satisfied.

Accordingly, if $DC_{DI}>DCDI_{TH}$ at 1010, Engine Speed>Engine $Speed_{TH}$ at 1020, $Q_{inj,fuel}>Q_{inj,fuel,TH}$ at 1030, or $t_{FRP}>t_{FRP,TH}$ at 1040, then method 1000 continues to 1050 where the FRP detection time condition is satisfied before returning to method 800 at 824. If $DC_{DI}<DCDI_{TH}$ at 1010, Engine Speed<Engine $Speed_{TH}$ at 1020, $Q_{inj,fuel}<Q_{inj,fuel,TH}$ at 1030, and $t_{FRP}<t_{FRP,TH}$ at 1040, then method 1000 continues to 1060 where the FRP detection time condition is not satisfied before returning to method 800 at 830.

Returning to FIG. 8 at 824, in response to the FRP detection time condition being satisfied, method 800 sets $V_{LiftPump}$ to $V_{LiftPump,TH3}$. In one example, $V_{LiftPump,TH3}$ may be a lift pump voltage that is greater than $V_{LiftPump,TH2}$ but less than a high threshold voltage, $V_{High,TH}$ as described below. For example, $V_{LiftPump,TH3}$ may be 11 V. As an example, $V_{LiftPump,TH3}$ may comprise a lift pump voltage sufficiently high to increase fuel flow rates through jet pumps to maintain fuel reservoir and main fuel sump fuel levels, and to supply sufficient fuel to the DI pump and fuel rail to reduce a risk of the vehicle engine stalling due to a drop in FRP. Accordingly, operating the lift pump at $V_{LiftPump,TH3}$ may preemptively mitigate a precipitous FRP pressure drop (e.g., 50 bar pressure drop) by increasing flow rates of fuel transferred to the main fuel sump and/or fuel reservoir via jet pumps, and by increasing fuel flow rates to the DI pump and the fuel rail. In this way fuel pressure in the fuel rail can be maintained at current engine operating conditions and a precipitous drop in FRP can be mitigated. Controller 222 may maintain the $V_{LiftPump}$ at $V_{LiftPump,TH3}$ until the FRP detection time condition ceases to be satisfied. After execution of 824, method 800 completes execution of the third control mode 826, and method ends.

Returning to 822, if the FRP detection time condition is not satisfied, method 800 continues at 830, where it determines or estimates a DI pump volumetric efficiency based on engine operating conditions. As described above with reference to FIG. 2, the efficiency (e.g., volumetric) of the DI pump (e.g., higher pressure fuel pump 214) may be at least partially parameterized by the fuel pressure at its inlet; as such, intermittent lift pump operation may be selected according to this inlet pressure, as this pressure may partially determine the efficiency of higher pressure fuel pump 214. In other examples, the efficiency of higher pressure fuel pump 214 may be predicted based on the rate of fuel consumption by engine 202, as well as one or more DI pump characteristics such as DI pump piston leakage, DI pump compression ratio and fluid bulk modulus, and DI pump check valve actuation model. DI pump efficiency may also be at least partially based on the difference between the volumetric flow of fuel to the DI pump (e.g., from the fuel lift pump) and the rate of fuel consumption by engine 202. Further still, DI pump efficiency may also decrease due to fuel vaporization and the DI pump sucking or pumping fuel vapor and/or air instead of liquid fuel. For example, a DI pump model may compute an expected DI pump volumetric flow rate and compare the expected DI pump volumetric flow rate to the commanded pump volumetric flow rate. A difference between the expected DI pump volumetric flow rate and the commanded pump volumetric flow rate may be computed as a lost DI pump volumetric fuel flow rate. A DI pump volumetric efficiency, $Efficiency_{DI}$, may then be computed by normalizing the lost DI pump volumetric fuel flow rate by the DI pump volumetric fuel flow rate when the DI pump is commanded to 100% and has a 100% volumetric efficiency (e.g., 100% nominal DI pump flow).

At 832, method 800 begins execution of a fourth control mode 836 of the lift pump by determining if $Efficiency_{DI}$ is less than a threshold DI pump volumetric efficiency, $Efficiency_{DI,TH}$. In one example, $Efficiency_{DI,TH}$ may be a DI pump efficiency below which a risk of fuel vaporization, which can cause engine stalling, is high. In another example, the $Efficiency_{DI,TH}$ may be a DI pump efficiency below which fuel economy is degraded more than a tolerable amount. As an example, $Efficiency_{DI}$ may be 85%. If $Efficiency_{DI}<Efficiency_{DI,TH}$ method 800 continues to 834. If $Efficiency_{DI}$ is not less than $Efficiency_{DI,TH}$, method 800 completes execution of the fourth control mode 836 and method 800 continues at 840.

At 834, responsive to $Efficiency_{DI}<Efficiency_{DI,TH}$ controller 222 may operate fuel lift pump in a pulse and increment mode, wherein controller 222 pulses $V_{LiftPump}$ to a high threshold voltage, $V_{High,TH}$. By pulsing $V_{LiftPump}$ to $V_{High,TH}$, fuel flow from the lift pump to the DI pump may be increased to a flow rate sufficient to raise and maintain the DI pump efficiency above $Efficiency_{DI,TH}$. In one example, $V_{High,TH}$ may be 12 V. In one example, controller 222 may pulse $V_{LiftPump}$ to $V_{High,TH}$ until $Efficiency_{DI}$ increases above $Efficiency_{DI,TH}$. In another example, controller 222 may sustain $V_{LiftPump}$ at $V_{High,TH}$ for at least a threshold duration before reducing $V_{LiftPump}$. In any case, once the pulsing of $V_{LiftPump}$ to $V_{High,TH}$ concludes, controller 222 may restore $V_{LiftPump}$ to its value just prior to the pulsing plus a threshold incremental voltage ($\Delta V_{INC,TH}$). By incrementing $V_{LiftPump}$ by the threshold incremental voltage ($\Delta V_{INC,TH}$) in addition to pulsing $V_{LiftPump}$, the risk of $Efficiency_{DI}$ decreasing below $Efficiency_{DI,TH}$, and thus the risk of fuel economy degrading and incurring significant fuel vaporization leading to engine stalling may be reduced. In one example, the threshold incremental voltage may be 0.2 V.

Turning briefly to FIG. 12, it shows a timeline 1200 illustrating the pulse and increment mode just described for increasing $Efficiency_{DI}$, including trend lines showing $Efficiency_{DI}<Efficienc_{DI,TH}$ 1210, Lift pump voltage 1220, and Lift pump pressure 1230. $V_{LiftPump,TH}$ 1228 is also plotted with the Lift pump voltage 1220. Timeline 1200 shows a series of lift pump voltage pulses to $V_{LiftPump,TH}$ occurring at times t11, t13, and t15, responsive to $Efficiency_{DI}$ decreasing below $Efficiency_{DI,TH}$ at those respective times. Each pulse beginning at times t11, t13, and t15 is sustained until after the $Efficiency_{DI}$ is no longer less than $Efficiency_{DI,TH}$ at times t12, t14, and t16, respectively. In the example of timeline 1200, the pulsing of $V_{LiftPump}$ to $V_{LiftPump,TH}$ responsive to $Efficiency_{DI}$ decreasing below $Efficiency_{DI,TH}$ is sustained until $Efficiency_{DI}$ is no longer less than $Efficiency_{DI,TH}$, and thus each of the pulses may be for different durations. However, as described above, in another example, each pulse responsive to $Efficiency_{DI}$ decreasing below $Efficiency_{DI,TH}$ may alternately be sustained for a threshold duration. Furthermore, after the conclusion of each pulse at times t12, t14, and 16, $V_{LiftPump}$ is restored to its original voltage level plus an incremental voltage as shown by 1226, 1224, and 1222, respectively. In another example, the pulse and increment mode may comprise controller 222 controlling the lift pump based on the lift pump pressure 1230, $P_{LiftPump}$, instead of the lift pump voltage 1200. For example, responsive to $Efficiency_{DI}$ decreasing below $Efficiency_{DI,TH}$, controller 222 may analogously pulse $P_{LiftPump}$ to a threshold lift pump pressure, $P_{LiftPump,TH}$ and then increment $P_{LiftPump}$ by a threshold incremental pressure.

Returning to FIG. 8, after executing 834 method 800 completes execution of the fourth control mode 836 and method 800 ends. Returning to 832, if $Efficiency_{DI}$ is not let than $Efficiency_{DI,TH}$, method 800 completes execution of the fourth control mode and method 800 continues at 840 where it determines $V_{LiftPump}$ (and lift pump pressure, $P_{LiftPump}$). In one example, method 800 may determine $V_{LiftPump}$ (and $P_{LiftPump}$) based on fuel temperature and fuel flow rate. At 842, method 800 begins execution of base control mode 846 of lift pump by determining if a fuel vaporization condition is met (e.g., $V_{LiftPump}<V_{fuel,novap}$). If $V_{LiftPump}<V_{fuel,novap}$, method 800 continues to 844 where $V_{LiftPump}$ is set to $V_{fuel,novap}$. In order to reduce fuel consumption, the electrical energy delivered to the lift pump may be lowered when the lift pump demand is low (e.g., engine idling, very low fuel flow rates, and the like). When pump lift pump demand is lower, the lift pump pressure and the fuel passage pressure upstream of the DI pump may thus be lower. During cold fuel temperatures, the commanded lower lift pump voltages less than $V_{fuel,novap}$ may result in lift pump pressures below the fuel vaporization pressure. Thus, by maintaining $V_{LiftPump}$ at $V_{fuel,novap}$ or greater, the base control mode of the lift pump may reduce fuel vaporization in the fuel system and increase engine robustness. After executing 844, or if $V_{LiftPump}$ is not less than $V_{fuel,novap}$ at 842, method 800 finishes execution of base control mode 846, and method 800 continues to 860.

At 860, method 800 determines if $V_{LiftPump}$ is less than $V_{LiftPump,TH2}$. If $V_{LiftPump}<V_{LiftPump,TH2}$, then method 800 does not execute the second control mode 866 and method 800 continues at 870. If $V_{LiftPump}<V_{LiftPump,TH2}$, then method 800 continues at 862, beginning execution of a second control mode 866 of the lift pump. At 862, method 800 determines if a first fuel level condition is met. Turning briefly to FIG. 9, method 900 illustrates how the first fuel level condition may be evaluated. At 910, method 900 determines if a fuel tank level, $Level_{FuelTank}$ is less than a threshold sump level, $Level_{Sump,TH}$. As a non-limiting example, the threshold sump level may be 10% of a full fuel tank level. For example, the fuel tank level may comprise the main fuel sump level, and the threshold fuel level may comprise 10% of the filled level of the main fuel sump 280. In one example, 10% of the filled level of the main fuel sump 280 may correspond to the main fuel sump fuel level below which if the fuel reservoir fuel level 291 is at the same level as the main fuel sump fuel level 281, that fuel may not be reliably transferred to the fuel reservoir from the main fuel sump by the main or transfer jet pump. As illustrated in FIGS. 2 and 3, the fuel tank level may be measured by fuel level sensors 262. In other examples, fuel tank levels may be estimated using fuel consumption data, fuel refill volumes, fuel line compliance, fuel system accumulator volume, fuel tank dimensions, and the like.

In one example, an algorithm for determining fuel reservoir fuel level may be based on a net fuel flow rate pumped by fuel system jet pumps being directly proportional to lift pump pressure. Estimating fuel reservoir level changes may include integrating the difference between jet pump fuel flow rate and the injection fuel flow rate. The integrated difference between jet pump fuel flow rate and the injection fuel flow rate could be clipped by the reservoir volume (e.g. 800 cc) to avoid over accumulation of the error signal. The fuel reservoir fuel level at engine start may be used to initialize the reservoir fill volume for the algorithm.

If the controller 222 determines that the main fuel sump level, $Level_{FuelTank}$, is not less than 10% of the full level of the main fuel sump (e.g., $Level_{Sump,TH}$), then method 900 continues at 912. At 912 method 900 determines if the estimated or measured fuel reservoir fuel level 291, $Level_{Reservoir}$ is less than a second threshold fuel reservoir level, $Level_{Reservoir,TH2}$. In some fuel systems, the fuel reservoir level may be measured by a fuel level sensor 266. In other examples, the fuel reservoir level may be estimated based on various engine operating conditions such as lift pump pressure, duration a lift pump pressure is below a low threshold pressure, main fuel sump level, secondary fuel sump level, fuel injection flow rate, and the like. For example, if the lift pump pressure is operated below the low threshold pressure, $P_{low,TH}$, for an extended duration beyond a threshold duration, $\Delta t_{TH}$, and the fuel tank level (e.g., main sump fuel level 281) is below $Level_{Sump,TH}$, the reservoir level may have decreased below $Level_{Reservoir,TH2}$ because fuel flow rates transferred by main and transfer jet pumps to the fuel reservoir 285 may be very low. In this way, controller 222 determines at 912 that $Level_{Reservoir}$ is not less than $Level_{Reservoir,TH2}$, then method 900 continues to 914 because a first fuel level condition is not met, and method 900 returns to method 800 at 870. If controller 222 determines that either $Level_{FuelTank}<Level_{Sump,TH}$ at 910 or $Level_{Reservoir}<Level_{Reservoir,TH2}$ at 912, then method 900 continues from 910 or 912 respectively to 916, because the first fuel level condition is met, and method 900 then returns to method 800 at 864. $Level_{Reservoir,TH2}$ may correspond to a low fuel reservoir fuel level that is less than the filled fuel reservoir level 287. In other words, when the fuel reservoir fuel level is below $Level_{Reservoir,TH2}$, there may be increased risk for jet pump performance degradation causing increased risk for lift pump cavitation, a precipitous FRP pressure drop, and engine stalling.

Returning to FIG. 8, responsive to the first fuel level condition being met, method 800 continues at 864 where the lift pump voltage, $V_{LiftPump}$ is increased to a second threshold lift pump voltage, $V_{LiftPump,TH2}$. Raising $V_{LiftPump}$ to $V_{LiftPump,TH}$ aids in increasing jet pump performance whereby flow rates of fuel transferred by the transfer and/or main jet pumps to the fuel reservoir and main fuel sump can be increased. In one example, $V_{LiftPump,TH}$ may be greater than 5 V, but less than 11 V (e.g., less than $V_{LiftPump,TH3}$). As described above with reference to FIG. 2 with respect to lift pump control methods, the responsive controller action at 864 may analogously be based on lift pump pressures rather than lift pump voltages. For example, operating lift pump at $V_{LiftPump,TH2}$ (e.g., $V_{LiftPump}>5$ V) may correspond to operating lift pump at a second threshold lift pump pressure, $P_{LiftPump,TH2}$, of >200 kPa. For example, controller 222 at 864 may alternately raise a lift pump pressure to a second threshold lift pump pressure responsive to a low fuel reservoir level or a low main fuel sump level. In this way, a fuel reservoir level below $Level_{Reservoir,TH2}$ and a main fuel sump level below $Level_{Sump,TH}$ can be expediently increased, mitigating cavitation of the fuel lift pump 282, which can cause precipitous drops in fuel rail pressure and engine stalling. Controller 222 may maintain $V_{LiftPump}$ at $V_{LiftPump,TH2}$ until the first level fuel condition is not met. Because the second control mode 866 is not executed unless $V_{LiftPump}<V_{LiftPump,TH2}$, the second control mode 866 can be understood to enforce $V_{LiftPump}\geq V_{LiftPump,TH2}$. In other words if $V_{LiftPump}>V_{LiftPump,TH2}$ and engine conditions are such that a first level fuel condition is satisfied, the second control mode 866 takes no action since the lift pump pressure and resulting jet pump flows may be sufficient for maintaining and replenishing the fuel reservoir and main sump fuel levels at $Level_{Reservoir,TH2}$ and $Level_{Sump,TH}$, respectively. After executing 864, method 800 completes the second control mode 866 and method 800 ends.

Returning to 862, if the first fuel level condition is not met, method 800 completes the second control mode 866 and continues at 870 where it determines if $V_{LiftPump}$ is less than $V_{LiftPump,TH1}$. If $V_{LiftPump}$ is not less than $V_{LiftPump,TH1}$, method 800 ends. If $V_{LiftPump}$ is less than $V_{LiftPump,TH1}$, method 800 continues at 872, beginning the first control mode 876, where it determines if a second fuel level condition is met. Turning briefly to FIG. 9, method 902 illustrates how the second fuel level condition may be evaluated. At 920, method 902 determines if a main fuel sump fuel level 281, $Level_{Sump}$, is less than a first threshold fuel reservoir fuel level, $Level_{Reservoir,TH1}$. As an example, $Level_{Reservoir,TH1}$ may comprise the level of the lip of the fuel reservoir, or the filled fuel reservoir level 287. As described above, $Level_{Sump}$ may be measured using a fuel level sensor 262 and/or estimated using various engine operating parameters. If $Level_{Sump}$ not less than $Level_{Reservoir,TH1}$, method 902 continues at 922 where it determines if a fuel level in fuel reservoir 285, $Level_{Reservoir}$, is less than a first threshold fuel reservoir fuel level, $Level_{Reservoir,TH1}$. As described above, $Level_{Reservoir}$ may be measured by a fuel level sensor 266 and/or estimated based on various engine operating parameters. If $Level_{Reservoir}$ is not less than $Level_{Reservoir,TH1}$, method 902 continues at 924 because a second fuel level condition is not met before returning to method 800 where method 800 ends. If at 920 $Level_{Sump}<Level_{Reservoir,TH1}$, or if at 922 $Level_{Reservoir}<Level_{Reservoir,TH1}$, then method 902 continues at 926 because a second fuel level condition is met before returning to method 800 at 874.

Returning to FIG. 8, responsive to the second fuel condition being met, method 800 continues at 874, where the lift pump voltage $V_{LiftPump}$ is raised to a first threshold voltage, $V_{LiftPump,TH1}$. In one example, $V_{LiftPump,TH1}$ may correspond to a lift pump voltage of 5 V, wherein 5 V may correspond to the lift pump generating a lift pump pressure of 200 kPa, which ensures sufficient transfer flow rate of fuel from the main fuel sump 280 to the fuel reservoir 285 via the main jet pump (e.g., 394, 594) to raise the fuel reservoir fuel level 291 to the filled fuel reservoir level 287. Furthermore, $V_{LiftPump,TH1}$ may correspond to a lift pump voltage that ensures that the transfer flow rate of fuel from the secondary fuel sump 270 to the main fuel sump 280 via the transfer jet pump (e.g., 290, 378) is sufficiently high to raise the main fuel sump fuel level 281 to the filled reservoir fuel level 291. In this way, the lift pump operation can be responsive to mitigating a fuel reservoir fuel level 291 or a main sump fuel level 281 being below a filled reservoir fuel level 291, thereby mitigating lift pump cavitation and engine stalling. Because the first control mode 866 is not executed unless $V_{LiftPump}<V_{LiftPump,TH1}$, the first control mode 876 may be understood to enforce $V_{LiftPump}\geq V_{LiftPump,TH1}$. In other words if $V_{LiftPump}>V_{LiftPump,TH1}$ and engine conditions are such that a second level fuel condition is satisfied, the first control mode 876 takes no action since the lift pump pressure and resulting jet pump flows may be sufficient for maintaining and replenishing the fuel reservoir and fuel tank fuel levels at $Level_{Reservoir,TH1}$. After execution of 874, method 800 completes the first control mode 876 and ends.

The first threshold voltage, $V_{LiftPump,TH1}$ may be lower than the second threshold voltage, $V_{LiftPump,TH2}$ and correspondingly, the flow rate of fuel transferred by the main and transfer of jet pumps may be smaller when operating the lift pump responsive to the first fuel level condition being satisfied as compared to when operating the lift pump responsive to the second fuel level condition being satisfied. In other words, because $Level_{Reservoir,TH1}$ (e.g., filled fuel reservoir level 287) is higher than $Level_{Reservoir,TH2}$ and $Level_{Sump,TH}$, the risk of fuel depletion at the lift pump causing lift pump cavitation and the risk of decreased jet pump performance may be lower, and thus the lift pump voltage response to can be lower (and slower) when the first fuel level condition is satisfied, as compared to when the second fuel level condition is satisfied. In this manner, jet pump performance degradation and lift pump cavitation can be reduced while still further maintaining fuel economy since excess electrical energy is not supplied to operate the lift pump when the first fuel level condition is satisfied. Controller 222 may maintain $V_{LiftPump}$ at $V_{LiftPump,TH1}$ until the second fuel level condition is not longer satisfied, or until the first level fuel condition is satisfied at 862.

In addition to the above description, methods 800, 900, 902, and 1000 may be understood to comprise various lift pump control modes which may be activated and deactivated responsive to various engine operating conditions. As shown in FIG. 8, the third control mode 826, fourth control mode 836, base control mode 846, second control mode 866, and first control mode 876 may comprise the executable instructions of method 800, 900, 902, and 1000 enclosed within each respective dashed box of FIG. 8. As summarized by the table 1300 in FIGS. 8 and 13, a third control mode 826 may be activated responsive to an FRP detection time condition being satisfied; a fourth control mode 836 (e.g., pulse and increment mode) may be activated responsive to DI pump efficiency condition being satisfied; a base control mode 846 may be activated responsive to a fuel vaporization condition being satisfied (e.g., $V_{LiftPump}<V_{fuel,novap}$); a second control mode 866 may be activated responsive to a first fuel level condition being satisfied; and a first control mode 876 may be activated responsive to a second fuel level condition being satisfied.

As shown in FIGS. 8 and 13, the pulse and increment mode (e.g., fourth control mode 836) may be deactivated in response to an FRP detection time condition being satisfied. In this way, the third control mode 826 may operate the lift pump in an open loop manner, where responsive to an FRP detection time condition being satisfied, the lift pump voltage is increased to $V_{LiftPump,TH3}$. In other words, during the third control mode 826, the controller 222 may override the fourth control mode action of pulsing and incrementing $V_{LiftPump}$ responsive to a DI pump volumetric efficiency being below a threshold volumetric efficiency. Similarly, the base control mode 846, second control mode 866, and first control mode 876 may be deactivated in response to an FRP detection time condition being satisfied. In this way, when the third control mode 826 is activated, method 800 may end before executing actions from any other lift pump control modes shown in FIGS. 8-10. Since $V_{LiftPump,TH3}$ is greater than $V_{High,TH}$, $V_{LiftPump,TH2}$, and $V_{LiftPump,TH1}$, during the third control mode, the lift pump will be provided more than sufficient electrical energy to replenish and maintain fuel tank and fuel reservoir fuel levels at their filled levels, and to maintain $Eff_{DI}$ at or above $Eff_{DI,TH}$. In this way, method 800 may prioritize lift pump control to be responsive to reducing a risk of a drastic drop in FRP causing engine stalling over responding to a low DI pump efficiency (e.g., when a DI pump efficiency condition is satisfied), a risk of fuel vaporization in the fuel passages (e.g., when a fuel vaporization condition is satisfied), or low fuel reservoir levels and low jet pump flows (e.g., when a first or second level fuel condition is satisfied).

As shown in FIGS. 8 and 13, the base control mode 846, second control mode 866, and first control mode 876 may be deactivated in response to a DI pump efficiency condition being satisfied. As shown in FIG. 8, after executing the fourth control mode action 834, method 800 may end before executing any instructions from the base control mode 846, second control mode 866, or first control mode 876, thereby deactivating the base control mode 846, second control mode 866, and first control mode 876. Since $V_{High,TH}$ is greater than $V_{LiftPump,TH2}$, and $V_{LiftPump,TH1}$, during the fourth control mode, the lift pump will be provided more than sufficient electrical energy to replenish and maintain fuel tank and fuel reservoir fuel levels at their filled levels. In this way, when the fourth control mode 836 is activated, method 800 may prioritize lift pump control to be responsive to maintaining a DI pump volumetric efficiency greater than $Eff_{DI,TH}$, and thereby reducing a risk of DI pump cavitation and increasing engine robustness, over responding to a risk of fuel vaporization in the fuel passages (e.g., when a fuel vaporization condition is satisfied), or low fuel reservoir levels and low jet pump flows (e.g., when a first or second level fuel condition is satisfied).

Furthermore, as shown in FIGS. 8 and 13, the base control mode 846 may be overridden in response to a second control mode 866 being activated (e.g., $V_{LiftPump}<V_{LiftPump,TH2}$ and a first level fuel condition is satisfied). For example, the base control mode 846 may set $V_{LiftPump}$ to $V_{fuel,novap}$. However, if $V_{fuel,novap}<V_{LiftPump,TH2}$ and the first level fuel condition is satisfied, then the second control mode may be activated and $V_{LiftPump}$ will be set to $V_{LiftPump,TH2}$, thereby overriding the control action of base control mode 846. Further still, the first control mode 876 may be deactivated in response to a second control mode 866 being activated (e.g., $V_{LiftPump}<V_{LiftPump,TH2}$ and a first level fuel condition is satisfied). As shown in FIG. 8, after executing the second control mode action 864, method 800 may end before executing any instructions from the first control mode 876, thereby deactivating the first control mode 876. In this way, when the second control mode 866 is activated, method 800 may prioritize lift pump control to be responsive to maintaining $Level_{FuelTank}>Level_{Sump,TH}$ and $Level_{Reservoir}>Level_{Reservoir,TH2}$ (e.g., by enforcing $V_{LiftPump}\geq V_{LiftPump,TH2}$), and thereby reducing a risk of lift pump cavitation and increasing engine robustness, over responding to a risk of fuel vaporization in the fuel passages (e.g., when a fuel vaporization condition is satisfied), or low fuel reservoir levels and low jet pump flows when a second level fuel condition is satisfied.

Further still, as shown in FIGS. 8 and 13, the base control mode 846 may be overridden in response to a first control mode 876 being activated (e.g., $V_{LiftPump}<V_{LiftPump,TH1}$ and a second level fuel condition is satisfied). For example, the base control mode 846 may set $V_{LiftPump}$ to $V_{fuel,novap}$. However, if $V_{fuel,novap}<V_{LiftPump,TH1}$ and the second level fuel condition is satisfied, then the first control mode may be activated and $V_{LiftPump}$ will be set to $V_{LiftPump,TH1}$, thereby overriding the control action of base control mode 846. In this way, when the first control mode 876 is activated, method 800 may prioritize lift pump control to be responsive to maintaining $Level_{MainSump}>Level_{Reservoir,TH1}$ and $Level_{Reservoir}>Level_{Reservoir,TH1}$ (e.g., by enforcing $V_{LiftPump}\geq V_{LiftPump,TH1}$), and thereby reducing a risk of lift pump cavitation and increasing engine robustness, over responding to a risk of fuel vaporization in the fuel passages (e.g., when a fuel vaporization condition is satisfied).

Turning now to FIG. 11, it illustrates a timeline 1100 of the fuel lift pump operation according to method 800. Timeline 1100 includes trend lines for $Efficiency_{DI}<Efficiency_{DI,TH}$ 1102, $V_{LiftPump}$ 1110, $P_{LiftPump}$ 1120, $Level_{Sump}$ 1130, secondary fuel sump level 1138, fuel reservoir fuel level 1140, and engine rpm 1150. Also shown are $V_{LiftPump,TH3}$ 1112, $V_{LiftPump,TH2}$ 1114, $V_{LiftPump,TH1}$ 1116, $V_{High,TH}$ 1118, $P_{LiftPump,TH3}$ 1122, $P_{LiftPump,TH2}$ 1124, $P_{LiftPump,TH1}$ 1126, $P_{Pulse,TH}$ 1128, $P_{low,TH}$ 1125, $Level_{Sump,TH}$ 1134, $Level_{Reservoir,TH1}$ 1142, $Level_{Reservoir,TH2}$ 1144, and Engine $Speed_{TH}$ 1152.

Between times t1 and t2, the fuel lift pump can be seen to be operating in a fourth control mode (e.g., pulse and increment mode). In response to $Efficiency_{DI}<Efficiency_{DI,TH}$ events occurring at times t1, t1*a*, and t1*b*, controller 222 executes instructions to pulse $V_{LiftPump}$ to $V_{High,TH}$, sustaining the pulses each time momentarily (e.g., long enough for $Efficiency_{DI}$ to increase above $Efficiency_{DI,TH}$). Furthermore, after the pulsing at times t1, t1*a*, and t1*b*, controller 222 increments $V_{LiftPump}$ by a threshold incremental voltage. $P_{LiftPump}$ pulses and decays at times t1, t1*a*, and t1*b*, in response to the pulsing of $V_{LiftPump}$ at those times. Furthermore, the main fuel sump level 1130 decreases slowly as fuel from the main sump is transferred slowly via the main transfer pump to replenish the fuel reservoir. In this way, the DI pump efficiency can be maintained while conserving fuel economy.

Between times t1*b* and t2, the main fuel sump level 1130 decreases below $Level_{Sump,TH}$ 1134, thereby satisfying a first fuel level condition. In response, controller 222 activates a second control mode 866. Accordingly, controller 222 increases $V_{LiftPump}$ to $V_{LiftPump,TH2}$, sustaining the increase for a duration until the main fuel sump level 1130 increases above $Level_{Sump,TH}$ at time t2*a*, whereby the first fuel level condition is no longer satisfied. While the first fuel level condition is satisfied between times t2 and t2*a*, controller 222 maintains the increase of $V_{LiftPump}$ to $V_{LiftPump,TH2}$. Furthermore, responsive to the increase of $V_{LiftPump}$, $P_{LiftPump}$ also increases, and then decays once the first fuel level condition is no longer satisfied. As a result of the operation of fuel lift pump in the second control mode, fuel is transferred by the transfer jet pump from the secondary fuel sump to the main fuel sump. Accordingly, the secondary fuel sump level 1138 decreases as $Level_{Sump}$ is raised above $Level_{Sump,TH}$.

At time t3, $Level_{Reservoir}$ 1140 decreases below $Level_{Reservoir,TH1}$, thereby satisfying a second fuel level condition. In response, controller 222 activates a third control mode 876 and increases $V_{LiftPump}$ to $V_{LiftPump,TH1}$, sustaining the increase for a duration until $Level_{Reservoir}$ increases above $Level_{Reservoir,TH1}$ at time t3*a*, whereby the second fuel level condition is no longer satisfied. Furthermore, responsive to the increase of $V_{LiftPump}$, $P_{LiftPump}$ also increases higher, and then begins to decay at time t3*a* once the second fuel level condition is no longer satisfied. As a result of the operation of fuel lift pump in the third control mode, fuel is transferred by the main jet pump from the main fuel sump to fill the fuel reservoir.

Prior to time t4, $P_{LiftPump}$ decreases below a low threshold pressure, $P_{Low,TH}$ for a threshold duration, $\Delta t_{TH}$. During the long duration at low lift pump pressure, the fuel flow rate transferred by the jet pumps is low and hence, the fuel reservoir fuel level 1140 decreases below $Level_{Reservoir,TH2}$ and the main fuel sump level drops below $Level_{Sump,TH}$ at time t4. Accordingly, at t4, the first fuel condition is satisfied.

In response, controller 222 activates a second control mode 866 and increases $V_{LiftPump}$ to $V_{LiftPump,TH2}$ for a duration until $Level_{Reservoir}$ is restored above $Level_{Reservoir,TH2}$. While $V_{LiftPump}$ is increased to $V_{LiftPump,TH2}$, the fuel flow rate from the transfer and main jet pumps increase so that both the fuel reservoir and main fuel sump fuel levels are raised. Furthermore, responsive to the increase of $V_{LiftPump}$, $P_{LiftPump}$ also increases higher, and then decays once the first fuel level condition is no longer satisfied.

At time t5, the engine speed increases above Engine $Speed_{TH}$, thereby satisfying an FRP detection time condition. In response, controller 222 activates a third control mode 826. Accordingly, controller 222 increases $V_{LiftPump}$ to $V_{LiftPump,TH3}$, sustaining the increase for a duration until the engine speed decreases below Engine $Speed_{TH}$ at time t5*a*, whereby the FRP detection time condition is no longer satisfied. While the FRP detection time condition is satisfied between times t5 and t5*a*, controller 222 maintains the increase of $V_{LiftPump}$ to $V_{LiftPump,TH3}$ despite $Efficiency_{DI}<Efficiency_{DI,TH}$ events and despite the second level fuel condition being satisfied occurring just after time t5, as shown in timeline 1100. In other words, while the third control mode is activated, the fourth control mode and the first control mode are deactivated. However, in the example of timeline 1100, since $V_{LiftPump,TH3}>V_{High,TH}$, the DI pump efficiency may be maintained while the third control mode is active. Furthermore, since $V_{LiftPump,TH3}>V_{LiftPump,TH2}$, fuel levels in the fuel reservoir and fuel tank may be replenished and maintained while the third control mode is active. Further still, responsive to the increasing of $V_{LiftPump}$, $P_{LiftPump}$ also increases higher, and then decays once the FRP detection time condition is no longer satisfied. As a result of the operation of fuel lift pump in the third control mode, fuel is transferred by the transfer jet pump from the secondary fuel sump to the main fuel sump and by the main jet pump from the main sump to the fuel reservoir. Accordingly, shortly after time t5, the main fuel sump level 1130 begins to gradually increase and the fuel reservoir fuel level is restored to the filled fuel reservoir level. In this way, controller 222 may reduce the risk of a precipitous FRP drop while the FRP detection time condition is satisfied.

After time t6, the fuel lift pump can be seen to return to operating intermittently in a pulse and increment mode. In response to $Efficiency_{DI}<Efficiency_{DI,TH}$ events occurring at times t6 and t6*a* (and because an FRP detection time condition is not satisfied) controller 222 activates the pulse and increment mode (e.g., fourth control mode) and executes instructions to pulse $V_{LiftPump}$ to $V_{High,TH}$, sustaining the pulses each time momentarily (e.g., long enough for $Efficiency_{DI}$ to increase above $Efficiency_{DI,TH}$). Furthermore, after the pulsing at t6 and t6*a*, controller 222 increments $V_{LiftPump}$ by a threshold incremental voltage. $P_{LiftPump}$ pulses and decays at t6 and t6*a*, in response to the pulsing of $V_{LiftPump}$ at those times. Furthermore, the main fuel sump level 1130 decreases slowly as fuel from the main sump is transferred slowly via the main transfer pump to replenish the fuel reservoir. In this way, the DI pump efficiency can be maintained while conserving fuel economy.

In this way, the methods of operating a lift pump disclosed herein may achieve the technical effect of reducing risks of fuel vaporization, precipitous FRP pressure drops, and engine stalling, while maintaining DI pump efficiency and fuel economy, even during cold fuel conditions. Furthermore, jet pump performance degradation, due to low lift pump pressures can be reduced by operating the lift pump responsive to low fuel tank levels, low jet pump fuel reservoir levels, or when a risk of an FRP drop leading to engine stalling is high.

In this way, a vehicle fuel system may comprise a fuel tank including a transfer jet pump and a main jet pump fuel reservoir comprising a main jet pump, a fuel lift pump, a fuel injection pump receiving fuel from the lift pump and delivering fuel to a fuel rail, and a controller with computer readable instructions stored on non-transitory memory for executing methods and routines for operating a lift pump.

In one representation, a method for operating the lift pump may comprise: a method, comprising: increasing a lift pump voltage to a high threshold voltage responsive to a DI pump efficiency being below a threshold efficiency, and increasing the lift pump voltage to a first threshold voltage less than the high threshold voltage responsive to a main jet pump fuel reservoir level being less than a first threshold reservoir level. Additionally or alternatively, the method may further comprise increasing the lift pump voltage to the first threshold voltage responsive to a fuel tank level being less than the first threshold reservoir level. Additionally or alternatively, the method may further comprise increasing the lift pump voltage to a second threshold voltage responsive to the main jet pump fuel reservoir level being less than a second threshold reservoir level, wherein the second threshold reservoir level is less than the first threshold reservoir level, and wherein the second threshold voltage is greater than the first threshold voltage. Additionally or alternatively, the method may further comprise increasing the lift pump voltage to the second threshold voltage responsive to a lift pump pressure being less than a low threshold pressure for a threshold duration and the fuel tank level being less than a threshold sump level, wherein the threshold sump level is less than the first threshold reservoir level. Additionally or alternatively, the method may further comprise increasing the lift pump voltage to the second threshold voltage responsive to the fuel tank level being less than a threshold sump level, wherein the threshold sump level is less than the first threshold reservoir level. Additionally or alternatively, the method may further comprise increasing the lift pump voltage to a third threshold voltage responsive to an engine speed being greater than a threshold engine speed wherein the third threshold voltage is greater than the second threshold voltage. Additionally or alternatively, the method may further comprise increasing the lift pump voltage to a third threshold voltage responsive to a fuel injection flow rate being greater than a threshold fuel injection flow rate, wherein the third threshold voltage is greater than the second threshold voltage. Additionally or alternatively, the method may further comprise increasing the lift pump voltage to a third threshold voltage responsive to a DI pump duty cycle being greater than a threshold duty cycle, wherein the third threshold voltage is greater than the second threshold voltage. Additionally or alternatively, the method may further comprise operating a lift pump voltage at a third threshold voltage when an estimated time for a fuel rail pressure to decrease by a threshold pressure drop is greater than a threshold time interval wherein the third threshold voltage is greater than the second threshold voltage.

In another representation, a method may comprise operating a lift pump in a first mode responsive to a fuel tank level decreasing below a first threshold reservoir level, wherein the first mode comprises increasing a lift pump voltage to a first threshold voltage, and responsive to a DI pump efficiency decreasing below a threshold efficiency, deactivating the first mode and pulsing a lift pump voltage to a high threshold voltage greater than the first threshold voltage. Additionally or alternatively, the method may further comprise deactivating the first mode and operating the lift pump in a second mode responsive to a main jet pump fuel reservoir level decreasing below a second threshold reservoir level, wherein the second threshold reservoir level is below the first threshold reservoir level, and wherein the second mode comprises increasing the lift pump voltage to a second threshold voltage greater than the first threshold voltage and less than the high threshold voltage. Additionally or alternatively, the method may further comprise responsive to the DI pump efficiency decreasing below the threshold efficiency, incrementing the lift pump voltage by a threshold incremental voltage. Additionally or alternatively, the method may further comprise deactivating the first mode and operating the lift pump in the second mode responsive to the fuel tank level decreasing below a threshold sump level, wherein the threshold sump level is less than the first threshold reservoir level. Additionally or alternatively, the method may further comprise deactivating the first mode and operating the lift pump in a third mode responsive to a fuel injection flow rate increasing above a threshold flow rate, wherein the third mode comprises increasing the lift pump voltage to a third threshold voltage greater than the second threshold voltage and less than the high threshold voltage. Additionally or alternatively, the method may further comprise deactivating the first mode and operating the lift pump in a third mode responsive to an engine speed increasing above a threshold engine speed. Additionally or alternatively, the method may further comprise deactivating the first mode and operating the lift pump in a third mode responsive to a DI pump duty cycle increasing above a threshold DI pump duty cycle.

In another representation, a method may comprise responsive to a DI pump efficiency decreasing below a threshold efficiency, increasing a lift pump pressure to a high threshold pressure; and responsive to a main jet pump fuel reservoir level being less than a first threshold reservoir level increasing a lift pump pressure to a first threshold pressure less than the high threshold pressure. Additionally or alternatively, the method may further comprise responsive to a fuel tank level being less than the first threshold reservoir level, increasing the lift pump pressure to the first threshold pressure. Additionally or alternatively, the method may further comprise responsive to the main jet pump fuel reservoir level decreasing below a second threshold reservoir level less than the first threshold reservoir level, increasing the lift pump pressure to a second threshold pressure greater than the first threshold pressure. Additionally or alternatively, the method may further comprise responsive to the fuel tank level being below a threshold fuel tank level less than the threshold reservoir level, increasing the lift pump pressure to the second threshold pressure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

increasing a lift pump voltage to a high threshold voltage responsive to a DI pump efficiency being below a threshold efficiency, and increasing the lift pump voltage to a first threshold voltage less than the high threshold voltage responsive to a main jet pump fuel reservoir level being less than a first threshold reservoir level.

2. The method of claim 1, further comprising increasing the lift pump voltage to the first threshold voltage responsive to a fuel tank level being less than the first threshold reservoir level.

3. The method of claim 2, further comprising increasing the lift pump voltage to a second threshold voltage responsive to the main jet pump fuel reservoir level being less than a second threshold reservoir level, wherein the second threshold reservoir level is less than the first threshold reservoir level, and wherein the second threshold voltage is greater than the first threshold voltage.

4. The method of claim 3, further comprising increasing the lift pump voltage to the second threshold voltage responsive to a lift pump pressure being less than a low threshold pressure for a threshold duration and the fuel tank level being less than a threshold sump level, wherein the threshold sump level is less than the first threshold reservoir level.

5. The method of claim 3, further comprising increasing the lift pump voltage to the second threshold voltage responsive to the fuel tank level being less than a threshold sump level, wherein the threshold sump level is less than the first threshold reservoir level.

6. The method of claim 5, further comprising increasing the lift pump voltage to a third threshold voltage responsive to an engine speed being greater than a threshold engine speed wherein the third threshold voltage is greater than the second threshold voltage.

7. The method of claim 5, further comprising increasing the lift pump voltage to a third threshold voltage responsive to a fuel injection flow rate being greater than a threshold fuel injection flow rate, wherein the third threshold voltage is greater than the second threshold voltage.

8. The method of claim 5, further comprising increasing the lift pump voltage to a third threshold voltage responsive to a DI pump duty cycle being greater than a threshold duty cycle, wherein the third threshold voltage is greater than the second threshold voltage.

9. The method of claim 5, further comprising operating a lift pump voltage at a third threshold voltage when an estimated time for a fuel rail pressure to decrease by a threshold pressure drop is greater than a threshold time interval, wherein the third threshold voltage is greater than the second threshold voltage.

10. A method, comprising:

operating a lift pump in a first mode responsive to a fuel tank level decreasing below a first threshold reservoir level, wherein the first mode comprises increasing a lift pump voltage to a first threshold voltage, and responsive to a DI pump efficiency decreasing below a threshold efficiency, deactivating the first mode and pulsing a lift pump voltage to a high threshold voltage greater than the first threshold voltage.

11. The method of claim 10, further comprising:

deactivating the first mode and operating the lift pump in a second mode responsive to a main jet pump fuel reservoir level decreasing below a second threshold reservoir level, wherein the second threshold reservoir level is below the first threshold reservoir level, and wherein the second mode comprises increasing the lift pump voltage to a second threshold voltage greater than the first threshold voltage and less than the high threshold voltage.

12. The method of claim 11, further comprising, responsive to the DI pump efficiency decreasing below the threshold efficiency, incrementing the lift pump voltage by a threshold incremental voltage.

13. The method of claim 12, further comprising:

deactivating the first mode and operating the lift pump in the second mode responsive to the fuel tank level decreasing below a threshold sump level, wherein the threshold sump level is less than the first threshold reservoir level.

14. The method of claim 13, further comprising deactivating the first mode and operating the lift pump in a third mode responsive to a fuel injection flow rate increasing above a threshold flow rate, wherein the third mode comprises increasing the lift pump voltage to a third threshold voltage greater than the second threshold voltage and less than the high threshold voltage.

15. The method of claim 14, further comprising deactivating the first mode and operating the lift pump in a third mode responsive to an engine speed increasing above a threshold engine speed.

16. The method of claim 13, further comprising deactivating the first mode and operating the lift pump in a third mode responsive to a DI pump duty cycle increasing above a threshold DI pump duty cycle.

17. A method, comprising:

responsive to a DI pump efficiency decreasing below a threshold efficiency, increasing a lift pump pressure to a high threshold pressure; and responsive to a main jet pump fuel reservoir level being less than a first threshold reservoir level increasing a lift pump pressure to a first threshold pressure less than the high threshold pressure.

18. The method of claim 17, further comprising:

responsive to a fuel tank level being less than the first threshold reservoir level, increasing the lift pump pressure to the first threshold pressure.

19. The method of claim 18, further comprising:

responsive to the main jet pump fuel reservoir level decreasing below a second threshold reservoir level less than the first threshold reservoir level, increasing the lift pump pressure to a second threshold pressure greater than the first threshold pressure.

20. The method of claim 19, further comprising:

responsive to the fuel tank level being below a threshold fuel tank level less than the threshold reservoir level, increasing the lift pump pressure to the second threshold pressure.

* * * * *